US010459396B2

(12) United States Patent
Zensai et al.

(10) Patent No.: US 10,459,396 B2
(45) Date of Patent: Oct. 29, 2019

(54) IMAGE FORMING APPARATUS

(71) Applicant: CANON KABUSHIKI KAISHA, Tokyo (JP)

(72) Inventors: Shoichi Zensai, Yokohama (JP); Tomofumi Kawamura, Suntou-gun (JP); Hiroki Takano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 58 days.

(21) Appl. No.: 15/794,273

(22) Filed: Oct. 26, 2017

(65) Prior Publication Data

US 2018/0120758 A1 May 3, 2018

(30) Foreign Application Priority Data

Nov. 1, 2016 (JP) ..... 2016-214550

(51) Int. Cl.
*G03G 21/16* (2006.01)
*G03G 21/18* (2006.01)

(52) U.S. Cl.
CPC ..... *G03G 21/1633* (2013.01); *G03G 21/1647* (2013.01); *G03G 21/185* (2013.01); *G03G 2221/1654* (2013.01)

(58) Field of Classification Search
CPC .. G03G 21/16; G03G 21/185; G03G 21/1623; G03G 21/1633; G03G 21/1647; G03G 21/1817; G03G 21/1821; G03G 21/1825; G03G 21/1839; G03G 21/1842; G03G 2221/16; G03G 2221/169; G03G 2221/1654; G03G 2221/1853
See application file for complete search history.

(56) References Cited

U.S. PATENT DOCUMENTS

2007/0092280 A1* 4/2007 Nakazato ..... G03G 15/5004 399/75
2010/0054805 A1 3/2010 Numata et al.
2012/0063808 A1 3/2012 Matsuda

FOREIGN PATENT DOCUMENTS

EP 1 674 947 A1 6/2006
JP 2013-195541 A 9/2013

OTHER PUBLICATIONS

European Search Report issued in corresponding European Application No. 17199119.3 dated Feb. 16, 2018.
U.S. Appl. No. 15/794,284, filed Oct. 26, 2017 (First Named Inventor: Hiroki Takano).

* cited by examiner

*Primary Examiner* — Thomas S Giampaolo, II
(74) *Attorney, Agent, or Firm* — Venable LLP

(57) ABSTRACT

Provided is an image forming apparatus including: an apparatus main body; a plurality of units arranged adjacent to each other in the apparatus main body, and configured to be attachable to and detachable from the apparatus main body in the same insertion and removal direction; and a switching member 36 configured to be capable of taking any one of a first position in which attachment and detachment of one unit 4 of adjacent units among the plurality of units to and from the apparatus main body is allowed and attachment and detachment of another unit 5 of the adjacent units is restricted, and a second position in which the attachment and detachment of the one unit 4 is restricted and the attachment and detachment of the other unit 5 is allowed.

17 Claims, 18 Drawing Sheets

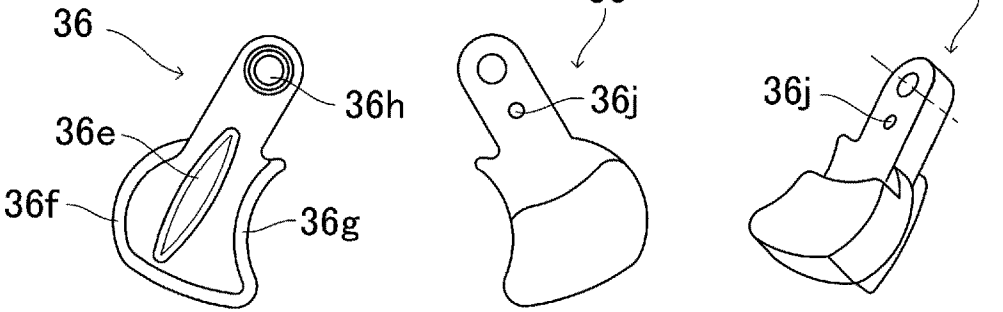
FIG.8A
FIG.8B
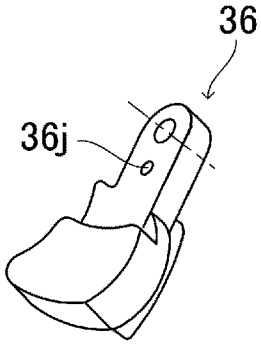
FIG.8C
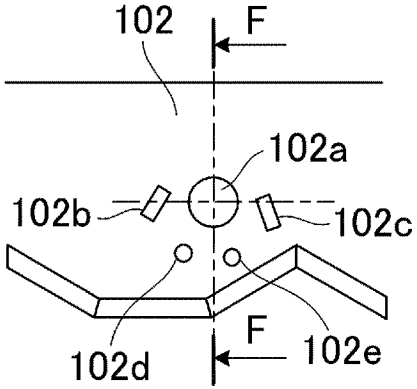
FIG.8D
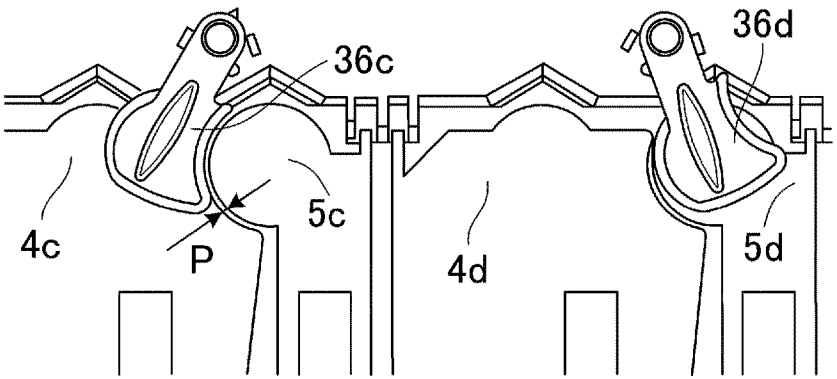
FIG.8E
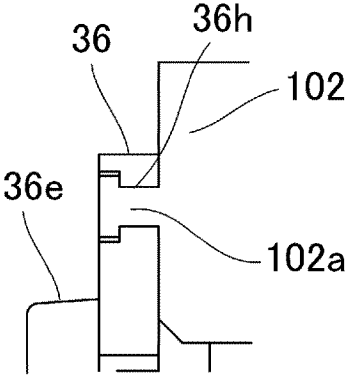
FIG.8F

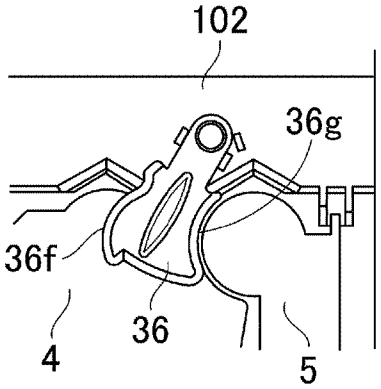
FIG.10A
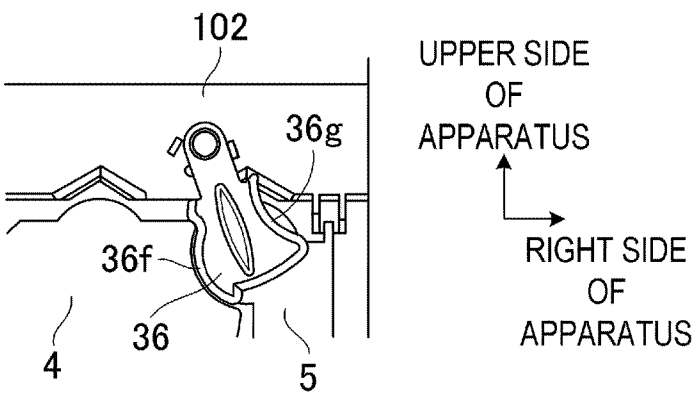
FIG.10B
FIG.10C
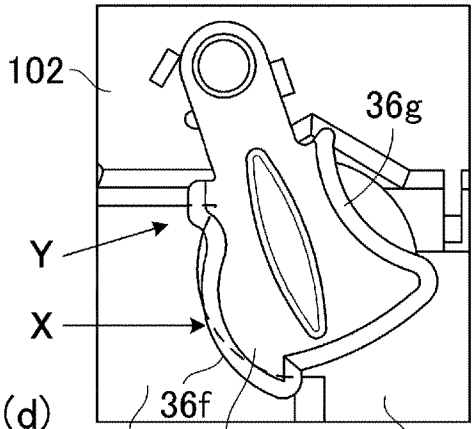
FIG.10D

UPPER SIDE OF APPARATUS
RIGHT SIDE OF APPARATUS
102
37e
37f
37g
37c
37d
4c
4d
5c
5d 37
102f

IMAGE FORMING APPARATUS

BACKGROUND OF THE INVENTION

Field of the Invention

The present invention relates to an image forming apparatus using an electrophotographic method.

Description of the Related Art

Examples of an image forming apparatus using an electrophotographic method include an image forming apparatus having an inline configuration in which a plurality of photosensitive members and process means (charging means, developing means, cleaning means, and the like) acting thereupon are provided, one belt capable of contacting each photosensitive member is also provided, and a color image can be formed on a transfer material. In recent years, there is a trend in the market to increase the capacity of toner cartridges in order to reduce cost per page (CPP). Further, in order to enable maintenance by replacing consumables at a minimum necessary level and reduce the operation cost of the apparatus, modular configurations of cartridges formed of a drum unit, a developing unit, a toner unit and the like have been developed. Japanese Patent Application Publication No. 2013-195541 suggests an apparatus configuration in which a contact developing system is used in the inline configuration and a developing unit can be pulled out from the apparatus main body in the axial direction of a photosensitive drum, while a developing roller and the photosensitive drum can be brought into and out of contact with each other. Specifically, an opening and an access door are provided on the front side of the apparatus so that the drum unit and the developing unit can be independently inserted, removed, and replaced in the apparatus main body.

For example, a configuration has been suggested in which drum cartridges and developing cartridges of yellow (Y), magenta (M), cyan (C), and black (K) can be independently inserted and removed from the access door on the front side of the apparatus (Japanese Patent Application Publication No. 2013-195541). It is naturally desirable to replace the cartridges one by one with both hands, and the apparatus configuration also assumes such a replacement operation. However, the case is also conceivable in which a user performs a replacement operation by simultaneously pulling out one cartridge by one hand and another cartridge by the other hand (for example, the case in which an Y drum cartridge is in one hand and an Y developing cartridge is in the other hand).

Where the user performs such attachment and detachment operations, the user can inadvertently drop the cartridge, or depending on the cartridge configuration, the cartridges can be brought into contact with each other, which can result in the rubbing or damage of the rollers and eventually cause image defects.

It is an object of the present invention to provide a technique capable of suppressing a user's operation that leads to damage of a cartridge during cartridge replacement.

SUMMARY OF THE INVENTION

In order to achieve the object described above, an image forming apparatus comprising:

an apparatus main body;

a plurality of units arranged adjacent to each other in a mounting space of the apparatus main body, and configured to be attachable to and detachable from the apparatus main body in the same insertion and removal direction;

a switching member configured to be capable of taking a first position in which attachment and detachment of one unit of adjacent units among the plurality of units to and from the apparatus main body is allowed and attachment and detachment of the other unit of the adjacent units is restricted, and a second position in which the attachment and detachment of the one unit is restricted and the attachment and detachment of the other unit is allowed; and an opening and closing member that opens and closes the mounting space of the plurality of units in the apparatus main body, wherein the switching member is configured to be located at the first position when the opening and closing member moves from a closed position in which the mounting space is closed to an open position in which the mounting space is open.

Further features of the present invention will become apparent from the following description of exemplary embodiments (with reference to the attached drawings).

BRIEF DESCRIPTION OF THE DRAWINGS

FIGS. 8A to 8F are schematic diagrams for explaining the configuration of a switching member in Example 1;

FIGS. 10A to 10D are schematic diagrams for explaining the configuration of the switching member in Example 2 of the present invention;

DESCRIPTION OF THE EMBODIMENTS

Hereinafter, a description will be given, with reference to the drawings, of embodiments of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

Examples of the image forming apparatus in which the present invention can be used include a copier, a printer, a facsimile, and a multifunctional machine which form an image on a recording material by using an electrophotographic method. In the case explained herein, the present invention is used in a color laser printer. The image forming apparatus of the present example is a four-color full-color laser beam printer using an electrophotographic process and performing color image formation on a recording material such as paper. Further, this image forming apparatus is of a process cartridge attachment and detachment system in which four, first to fourth, process cartridges are removably attached to an image forming apparatus main body.

Here, in the image forming apparatus, the front side or forward side is the side on which an access door 101 is disposed. The rear side or back side is the opposite side. The front-rear direction is the direction from the rear side to the front side (forward direction or frontward direction) and the opposite direction (backward direction or rearward direction). The left and right are left and right when the image forming apparatus is viewed from the front side. The left-right direction is the direction from the right to the left (leftward direction) and the opposite direction (rightward direction). The front-rear direction and the left-right direction are directions parallel to the horizontal direction. Further, the image forming apparatus main body is a constituent part of the image forming apparatus other than the process cartridge. With respect to the process cartridge or constituent members thereof or the constituent members on the apparatus main body side, the longitudinal direction is the axial direction of an electrophotographic photosensitive drum 1 as an image bearing member or a direction parallel to the axial direction thereof.

Image Forming Apparatus

Figure 1B:
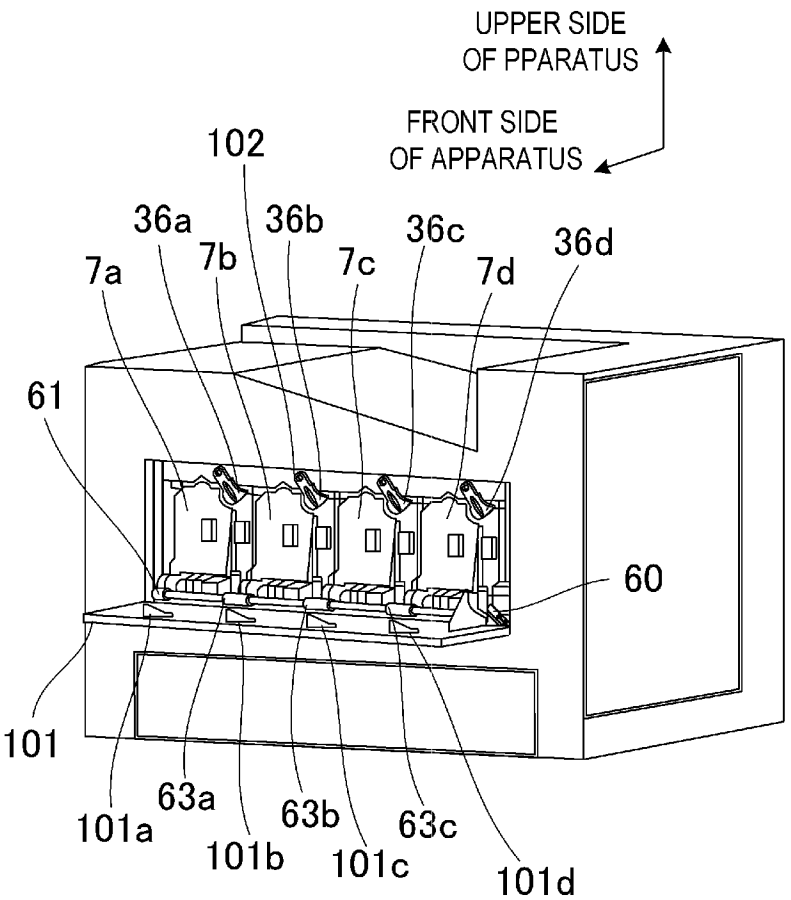
FIGS. 1A and 1B are schematic perspective views of an image forming apparatus according to Example 1.
Figure 1A:
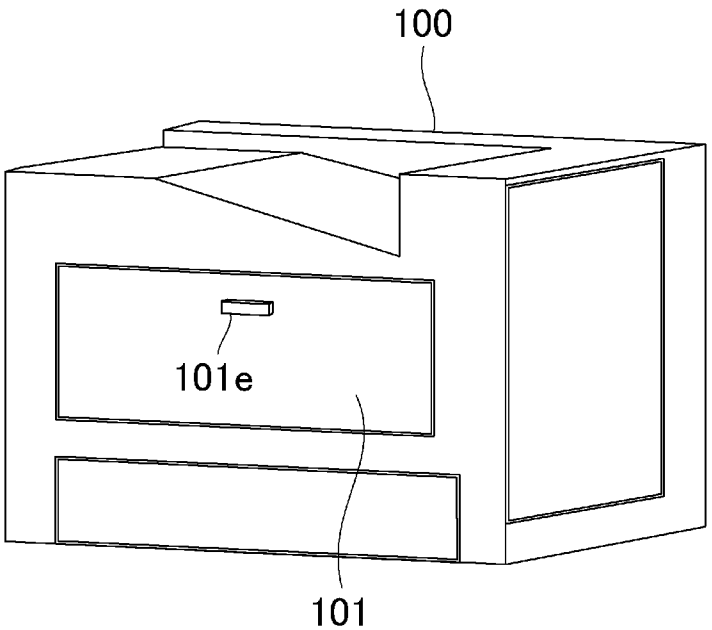

FIGS. 1A and 1B are schematic perspective views of a printer 100 as an image forming apparatus in which a process cartridge can be attached to and detached from an image forming apparatus main body (apparatus main body). FIG. 1A is a view taken in a state in which an access door 101 for opening and closing an opening portion provided in the apparatus main body for replacing a process cartridge 7 is in a closed state. FIG. 1B is a view taken when the access door 101 is in an open state. In a state where the access door 101 is opened, the process cartridge 7 (7*a*, 7*b*, 7*c*, 7*d*) can be pulled out toward the front of the apparatus.

Figure 2:
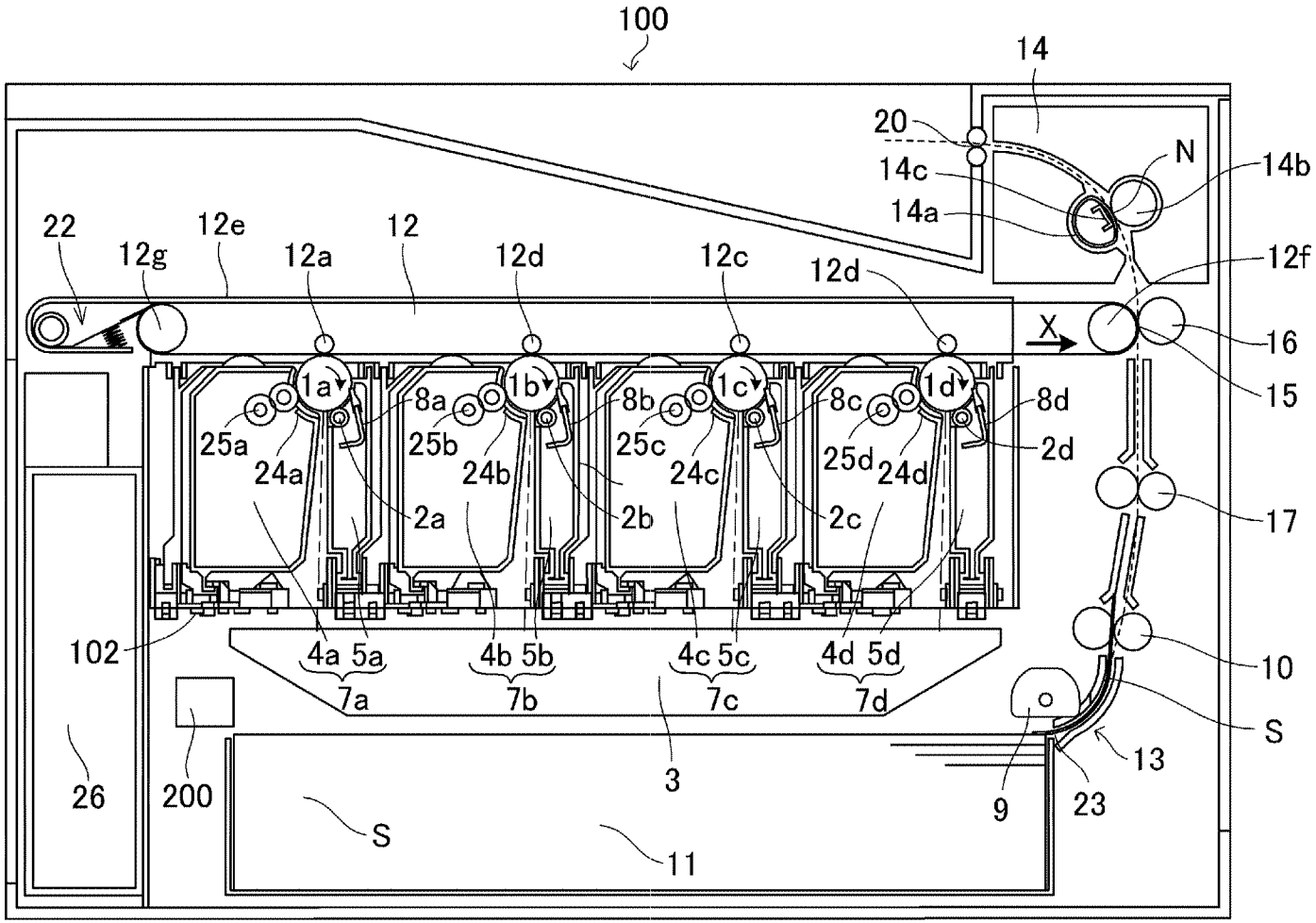
FIG. 2 is a schematic sectional view of the image forming apparatus according to Example 1.

FIG. 2 is a schematic sectional view of the printer 100 as viewed from the front side. A cassette 11 is housed in the lower portion of the printer 100 so that the cassette can be pulled out therefrom. In the cassette 11, a transfer material S as a recording material is stacked and stored, and the transfer material S can be separated and fed one by one. The printer 100 is provided with process cartridges 7*a*, 7*b*, 7*c*, and 7*d* (process cartridge 7) corresponding to yellow (Y), magenta (M), cyan (C), and black (K), respectively, as image forming means arranged side by side in a row. The process cartridge 7 is formed of two units, namely a developing unit 4 (4*a*, 4*b*, 4*c*, 4*d*) and a drum unit (cleaner unit) 5 (5*a*, 5*b*, 5*c*, 5*d*) holding a photosensitive drum. In the market, depending on the user's print contents, there are cases where the toner is consumed quickly and cases where the photosensitive drum is consumed quickly. That is, the timing at which toner replenishment (replacement of the developing unit) is necessary and the timing at which the replacement of the photosensitive drum (replacement of the drum unit) is necessary do not necessarily coincide. In the present example, the process cartridge 7 is formed of two units, that is, the developing unit 4 and the drum unit 5, which can be replaced individually. As a result, from the user's viewpoint, the printing cost can be reduced and resources can be saved.

In the process cartridges 7, the drum units 5 include photosensitive drums 1*a*, 1*b*, 1*c*, 1*d* (photosensitive drum 1) which are image bearing members, and charging devices 2*a*, 2*b*, 2*c*, 2*d* that uniformly and negatively charge the surface of the photosensitive drums 1. Further, the drum unit 5 includes cleaning blades 8*a*, 8*b*, 8*c*, 8*d* that remove residual toner remaining on the photosensitive drum 1 after the toner image is transferred, and a toner container for storing the untransferred toner.

In the developing units 4*a*, 4*b*, 4*c*, 4*d*, developing rollers 24 (24*a*, 24*b*, 24*c*, 24*d*) as the developer bearing members and developer application rollers 25*a*, 25*b*, 25*c*, 25*d* are rotatably supported by a frame body also serving as a toner storage container. The developing roller 24 causes the toner to adhere to an electrostatic latent image formed on the surface of the photosensitive drum 1 to develop this image as a toner image (developer image). The developing roller is urged so as to be pressed against the surface of the photosensitive drum 1 at the contact position with the photosensitive drum 1, so as to cause the toner to adhere.

In the description of the present application, the contact position is a developing position where the toner is caused to adhere to the electrostatic latent image on the photosensitive drum 1 to form a toner image, and this is a position where the developing roller 24 is in contact with the photosensitive drum 1 or a position where the developing roller 24 approaches the photosensitive drum 1. In other words, the developing roller 24 need not be in contact with the photosensitive drum 1 as long as the developing roller is at a position for forming a toner image by causing the toner to adhere to the electrostatic latent image on the photosensitive drum 1 (in this case as well, for convenience, this position will be referred to as contact position).

Figure 3B:
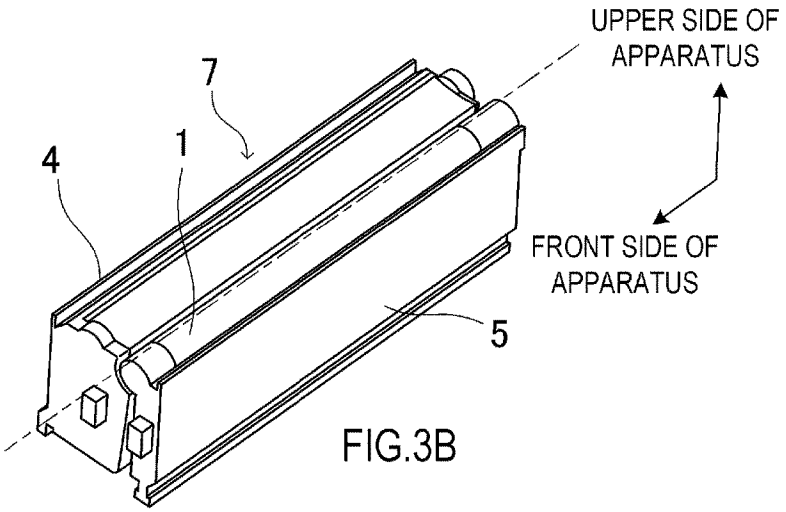
FIGS. 3A to 3D are schematic perspective views of the process cartridge in Example 1.
Figure 3D:
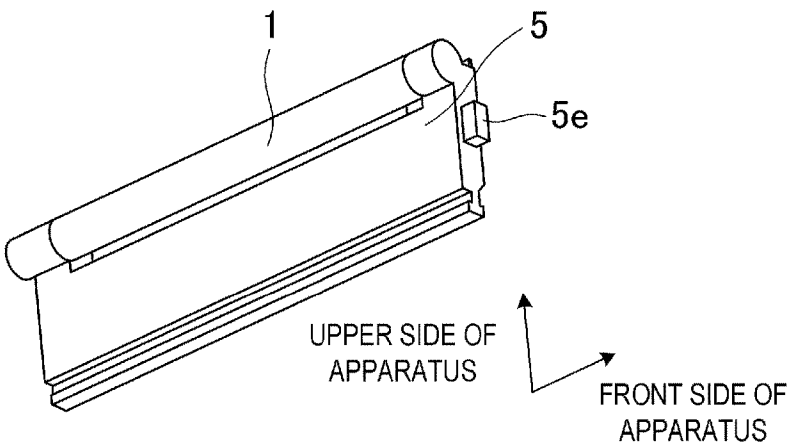
Figure 3A:
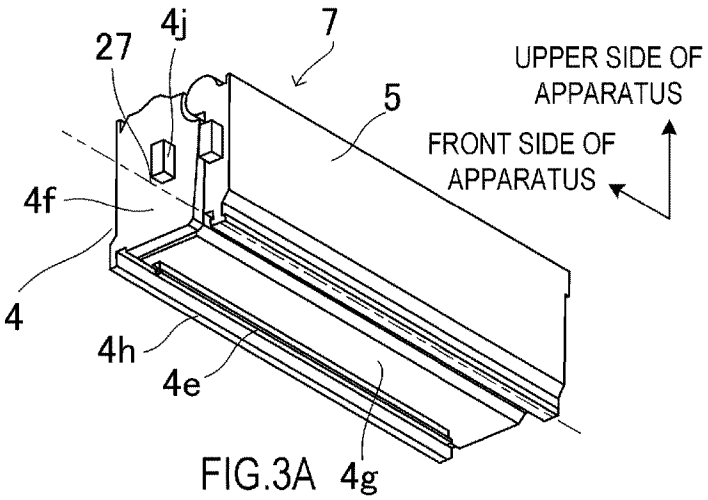
Figure 3C:
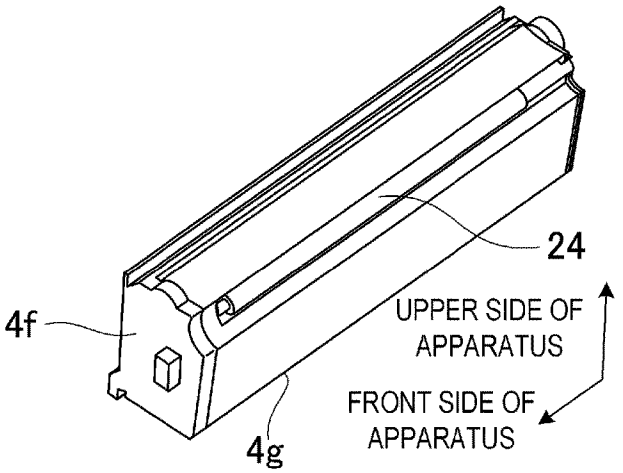

FIGS. 3A to 3D are schematic perspective views of the process cartridge 7 formed of two units, namely, the developing unit 4 and the drum unit 5 of the present example. FIGS. 3A and 3B are diagrams showing the developing unit 4 and the drum unit 5 in an arrangement state in which they interact with each other in relation to image formation as at the time of image formation. FIG. 3C is a perspective view of the developing unit 4, and FIG. 3D is a perspective view of the drum unit 5. The frame of the developing unit 4 is largely formed of a developing frame 4*f* and a developing container 4*g* and is configured to be swingable around a rotation shaft 27 as a swinging center by a support mechanism provided in the printer 100. As a result, the developing roller 24 is configured to be capable of coming into and out of contact with the photosensitive drum 1 (movable between a contact position and a separation position). The developing unit 4 and the drum unit 5 are provided with handle portions 4*j* and 5*e*, respectively.

With this configuration, the developing roller 24 is brought into contact with the photosensitive drum 1 (contact state) at the timing when the toner adheres to the electrostatic latent image formed on the photosensitive drum 1 to develop the image. In other periods, the developing roller 24 is separated from the photosensitive drum 1 as much as possible (standby state) to extend the life of the developing roller 24 and the photosensitive drum 1. A scanner unit 3 that emits a laser beam on the basis of image information to form an electrostatic latent image on the photosensitive drum 1 is provided below the process cartridge 7, and an intermediate transfer unit 12 is provided above the process cartridge 7.

As shown in FIG. 1B, switching member 36 (36*a*, 36*b*, 36*c*, 36*d*) for selectively inserting and removing the developing unit 4 and the drum unit 5 is provided for each process cartridge 7*a*, 7*b*, 7*c*, 7*d* on the frame 102 of the apparatus main body. Ribs 101*a*, 101*b*, 101*c*, 101*d* are provided on the inner side of the access door 101 in order to move the switching member 36 to the desired position when the state of the access door 101 is changed from open to closed.

The intermediate transfer unit 12 includes primary transfer rollers 12*a*, 12*b*, 12*c*, 12*d*, an endless cylindrical intermediate transfer belt 12*e*, a drive roller 12*f*, a tension roller 12*g*, and a cleaning device 22 that removes the toner present on the intermediate transfer belt 12*e*. The cleaning device 22 is disposed upstream of a primary transfer portion formed by the photosensitive drum 1*a* and the primary transfer roller 12*a* with respect to the movement direction (rotation direction shown by an arrow X in FIG. 2) of the intermediate transfer belt 12*e*. Also, the cleaning device is disposed downstream of a secondary transfer portion 15 formed by the drive roller 12*f* and a secondary transfer roller 16.

Further, the cleaning device 22 is positioned and held by the shaft of a tension roller 12*g*, and is configured so as to follow changes in the position of the tension roller 12*g*. In addition, since the intermediate transfer belt 12*e* and the cleaning device 22 are expendable items, the intermediate transfer unit 12 integrated with the cleaning device 22 can be detachably attached to the apparatus main body. The residual toner on the intermediate transfer belt 12*e* which has been collected by the cleaning device 22 is accumulated in a toner collection container 26 disposed in the printer 100.

When the drive roller 12*f* is rotationally driven by a drive source such as a motor (not shown), the intermediate transfer belt 12*e* rotates at a predetermined speed in the direction of the arrow X in FIG. 2. In primary transfer, a positive bias voltage is applied to the primary transfer rollers 12*a*, 12*b*, 12*c*, 12*d* and the difference in potential with the negatively charged surface of the photosensitive drum 1 is used to transfer the toner from the photosensitive drum 1 onto the intermediate transfer belt 12*e* (primary transfer).

The toner images on the photosensitive drum 1 are primary transferred onto the intermediate transfer belt 12*e* in each of the primary transfer portion formed by the primary transfer rollers 12*a*, 12*b*, 12*c*, 12*d* and the photosensitive drum 1 in the Y, M, C, K image forming stations. The toner image transferred onto the intermediate transfer belt 12*e* is transferred to the transfer material S in the secondary transfer portion 15 formed by the drive roller 12*f* and the secondary transfer roller 16. Thereafter, the transfer material S passes through a fixing apparatus 14 that fixes the transferred image, is conveyed by a discharge roller pair 20, and is discharged to a transfer material stacking portion.

Here, a feeding device 13 includes a paper feeding roller 9 for feeding the transfer material S from the paper feed cassette 11 where the transfer material S is accommodated, and a pair of conveying rollers 10 for conveying the fed transfer material S. The transfer material S accommodated in the paper feed cassette 11 is pressed against the paper feeding roller 9, separated one by one (friction piece separation system) by a separation pad 23, and conveyed. The transfer material S conveyed from the feeding device 13 is conveyed to the secondary transfer portion 15 by a registration roller pair 17.

The fixing apparatus 14 fixes the image formed on the transfer material S to the transfer material S by applying heat and pressure. The reference numeral 14*a* stands for a cylindrical fixing belt which is guided by a belt guide member 14*c* to which heat generating means such as a heater is bonded. The reference numeral 14*b* stands for an elastic pressure roller which, together with the belt guide member 14*c*, forms a fixing nip portion N having a predetermined width under a predetermined pressure contact force, with the fixing belt 14*a* interposed therebetween.

A configuration for urging and positioning the process cartridge with respect to the frame 102 in conjunction with the opening and closing of the access door 101 as the opening and closing member will be described hereinbelow in detail with reference to FIGS. 4A and 4B to FIG. 7.

Figure 4A:
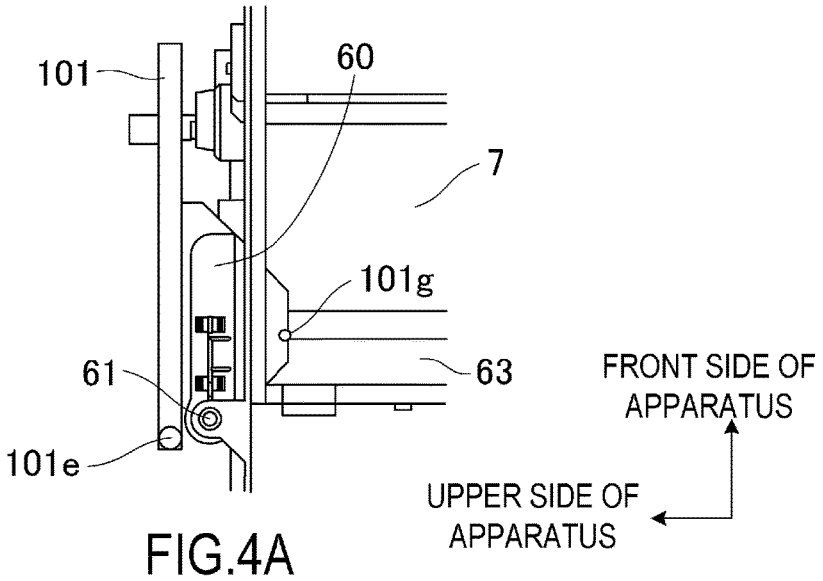
FIGS. 4A and 4B are schematic diagrams for explaining the opening and closing operation of an access door in Example 1.
Figure 4B:
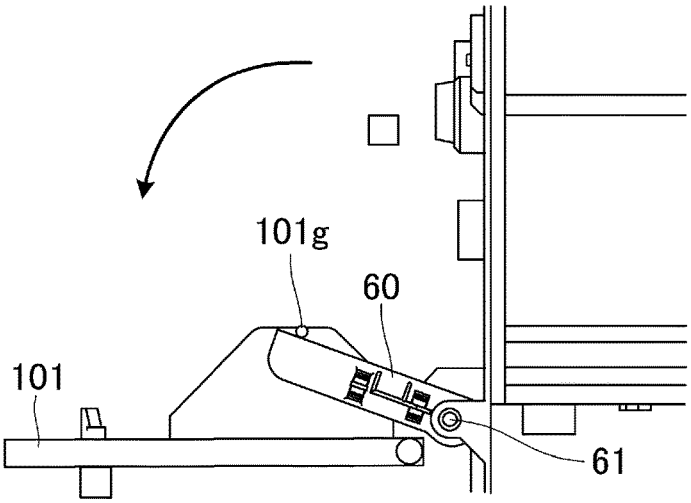

1) FIGS. 4A and 4B

FIGS. 4A and 4B are partially enlarged sectional views showing the access door 101, the process cartridge 7, and the periphery of a guide rail 63 of the process cartridge 7 in a plane orthogonal to the horizontal plane (left-right direction). The figures illustrate the relationship between the opening and closing operation of the access door 101 and the position of the process cartridge 7 and the like. FIG. 4A shows the state in which the access door 101 is in the closed position in which the mounting space of the process cartridge 7 in the apparatus main body is closed, and FIG. 4B shows the state in which the access door is in the open position in which the mounting space is open, both views being taken from the right side of the apparatus.

The frame 102 (FIG. 2) has a shaft 61 rotatably supported at both ends, and an interlock lever 60 is fixed thereto. The access door 101 has a rotating shaft 101*e* which is a rotating fulcrum of the access door 101. The access door 101 is provided with an engagement boss 101*g*, and the engagement boss 101*g* is engaged with the interlock lever 60 while the access door 101 makes a transition from the closed state to the open state. As the access door 101 is opened, the shaft 61 rotates through a desired angle in the direction indicated by a solid arrow in FIG. 4B.

Figure 5B:
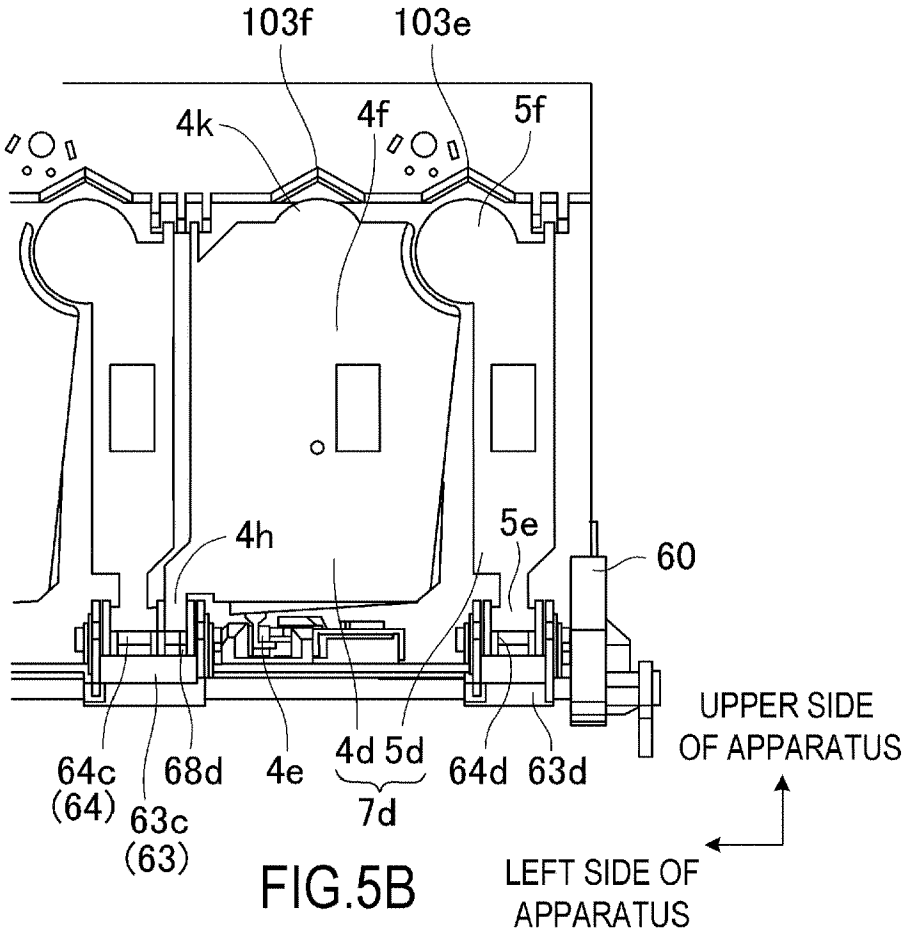
FIGS. 5A and 5B are schematic diagrams for explaining the opening and closing operation of the access door in Example 1.
Figure 5A:
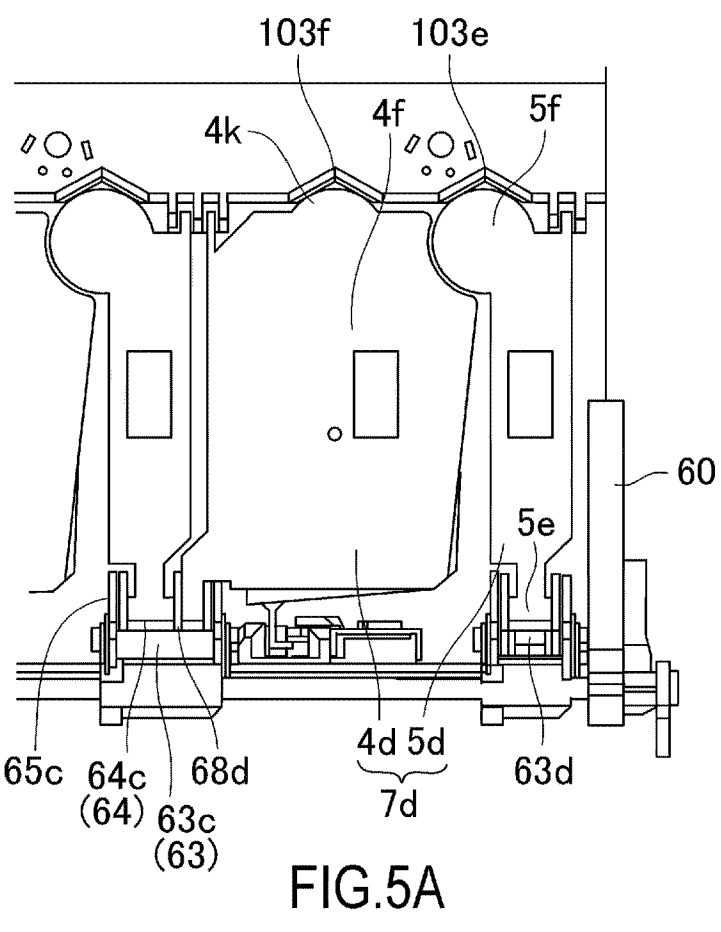

2) FIGS. 5A and 5B

FIG. 5A is an enlarged view showing the state in which the access door 101 is closed within a plane orthogonal to the horizontal plane (front-rear direction of the apparatus), and FIG. 5B is an enlarged view showing the open state, both views being taken from the front of the K station.

A lower portion 5*e* of the drum unit 5 of the process cartridge 7 is substantially T-shaped and is fitted to a guide rail 63*d* (63) having a cross section in a groove shape. In the upper part of the drum unit 5, a positioned portion 5*f* having a circular-arc shape at the support portion for supporting both ends of the photosensitive drum 1 is positioned at a V-shaped position restricting portion 103*e* provided on the frame of the apparatus main body 100. In the developing unit 4, too, a rib 4*h* of the developing frame 4*f* is fitted into the groove shape of the guide rail 63*c*, and an upper circular-arc shape 4*k* of the developing frame 4*f* is fitted to a V-shaped position restricting portion 103*f* provided on the frame of the apparatus main body 100.

As shown in FIG. 5B, in the open state of the access door 101, the urging of the cartridge to the position restricting portions 103*e*, 103*f* is released. For this reason, it is possible to pull out the process cartridge from the apparatus main body in a development separation state while keeping the operating force low.

Figure 6A:
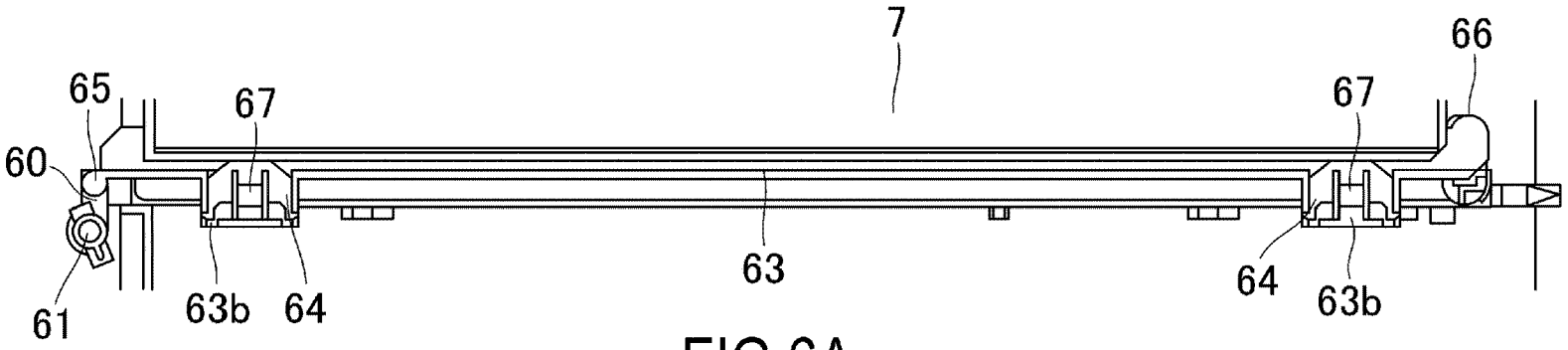
FIGS. 6A and 6B are schematic diagrams for explaining the relationship between a guide rail and the access door.
Figure 6B:
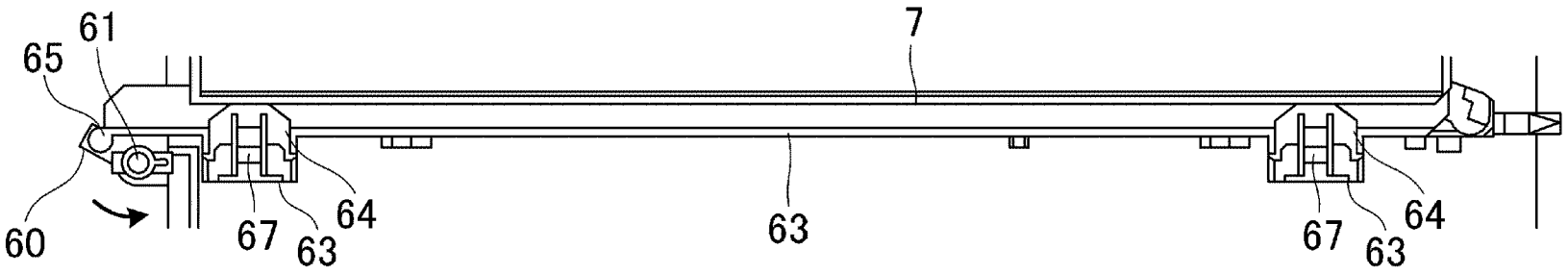

3) FIGS. 6A and 6B

FIGS. 6A and 6B are partially enlarged views illustrating the relationship between the guide rail 63 and the access door 101 in a plane orthogonal to the horizontal plane, this view being taken from the right side of the apparatus. FIGS. 6A and 6B show states in which the access door 101 is closed and open, respectively.

The guide rail 63 is connected to the interlock lever 60 which is rotatable on the shaft 61 by a rail arm 65 (65*a*, 65*b*, 65*c*, 65*d*) of the guide rail 63. Meanwhile, on the rear side of the apparatus, a rail arm 66 of the guide rail 63 is connected to a frame (not shown). As a result, in the guide rail 63, a four-section parallel link is formed as a link mechanism. A tension spring (not shown) is provided between the guide rail 63 and the frame, so that the guide rail 63 performs parallel movement such as shown in FIG. 6A from the state of the guide rail 63 shown in FIG. 6B, and the process cartridge 7 is urged to the position restricting portions 103*e* and 103*f* provided on the frame of the apparatus main body 100. Thus, the guide rail 63 and the process cartridge 7 can be raised, lowered and urged by opening and closing the access door 101. Further, pressing member housing portions 63*b* are provided at the guide rail 63 in two places in the front-rear direction. An urging member (compression spring) 67 is provided between the pressing member housing portion 63*b* and a pressing member 64, and the pressing member 64 is configured to urge the process cartridge 7 to the upper side of the apparatus with respect to the guide rail 63. Therefore, with the configuration in which the pressing member 64 (64*a*, 64*b*, 64*c*, 64*d*) is arranged in the guide rail 63, the process cartridge 7 is further urged by the pressing member 64 to the position restricting portion 103*e*, that is, to the upper side of the apparatus, in the closed state of the access door 101.

4) FIG. 7

Figure 7:
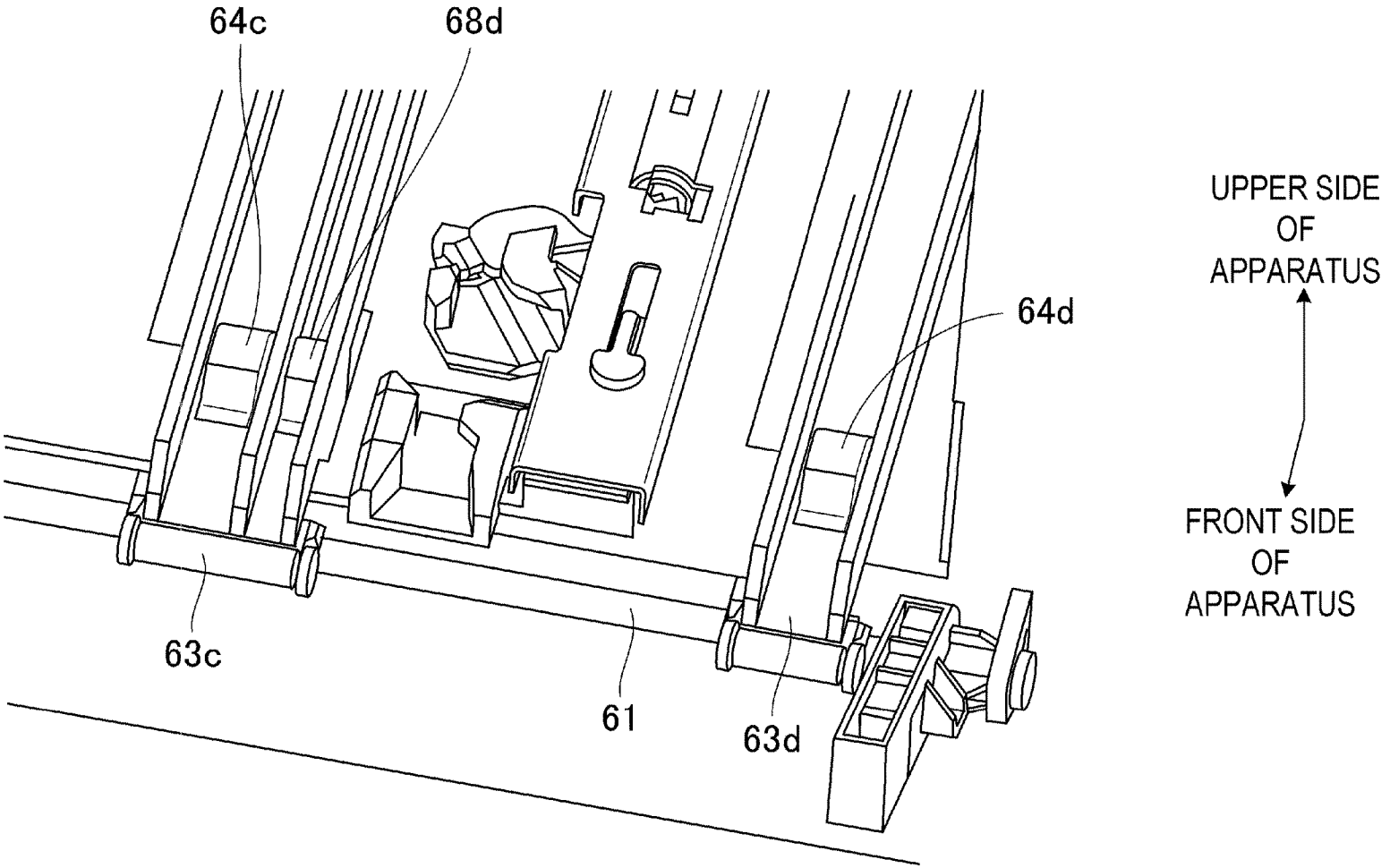
FIG. 7 is a perspective view showing the configuration of a shaft and the like interlocked with the guide rail and access door.

FIG. 7 is a partial perspective view showing the configuration of the guide rails 63*c*, 63*d* corresponding to cyan (C) and black (K) and the shaft 61. As described above, for the developing unit 4, a pressing member 68*d* for pressing the rib 4*h* (FIGS. 5A and 5B) of the developing frame 4*f* is provided on the guide rail 63*c*. The pressing member 68*d* is urged to the upper side of the apparatus by an urging member (compression spring) in the same manner as pressing member 64 for the drum unit 5.

Switching Member

The operation of the switching member (CRG lever) 36 (36*a*, 36*b*, 36*c*, 36*d*) on the process cartridge 7 (7*a*, 7*b*, 7*c*, 7*d*) will be described with reference to FIGS. 8A to 8F and FIGS. 9A to 9D. The developing unit 4 as one unit and the drum unit 5 as the other unit constituting the process cartridge 7 are arranged adjacent to each other in the apparatus main body and configured such that they can be detachably attached to the apparatus main body in the same insertion and removal direction. The CRG lever 36 is provided at the frame 102 so as to be located inside the apparatus main body when the access door 101 is in the closed position and to be exposed to the outside of the apparatus main body when the access door 101 is in the open position. The CRG lever 36 is configured to be taking either a first position where attachment and detachment of the developing unit 4 are allowed and attachment and detachment of the drum unit 5 are restricted or a second position where the attachment and detachment of the developing unit 4 are restricted and the attachment and detachment of the drum unit 5 are allowed. The CRG levers 36*a*, 36*b*, 36*c*, 36*d* thus configured are provided for the process cartridges 7*a*, 7*b*, 7*c*, 7*d* corresponding to Y, M, C, K, respectively.

1) FIGS. 8A to 8F

FIGS. 8A to 8F are schematic views for explaining the shape and function of the switching member. FIG. 8A is a front view of the CRG lever 36, FIG. 8B is a rear view of the CRG lever 36, FIG. 8C is a perspective view of the CRG lever 36, and FIG. 8D is a partially enlarged view of a frame 102 that rotatably holds the CRG lever 36. FIG. 8E is a view representing a state in which the developing unit 4*c* is restricted by the CRG lever 36*c* from being inserted and removed and the drum unit 5*d* is restricted by the CRG lever 36*d* from being inserted and removed. FIG. 8F is an F-F sectional view in FIG. 8D.

In FIG. 8A, the CRG lever 36 has a hole 36*h* which is fitted to a boss 102*a* of the frame 102 in the insertion and removal direction of the process cartridge 7, and the CRG lever 36 is held so as to be rotatable around the rotation axis extending in the insertion and removal direction of the process cartridge 7 with respect to the frame 102. Further, the CRG lever 36 is provided with an engaging portion 36*e* to enable the operation thereof by grasping when the user intends to replace the developing unit 4 or the drum unit 5. As shown in FIGS. 8B and 8C, a hemispherical projection 36*j* is formed on the back side of the CRG lever 36 and engaged with holes (recessed portions) 102*d*, 102*e* of the frame 102 to create a click feeling when the CRG lever 36 is operated. Ribs 102*b*, 102*c* provided on the frame 102 function as rotation stoppers for the CRG lever 36. One of the conditions required for the CRG lever 36 is that the width thereof in the direction orthogonal to the insertion and removal direction of the process cartridge 7 is larger than a gap P (FIG. 8E) between the developing unit 4 and the drum unit 5. The other condition is that the CRG lever 36 can retreat to the outside of the outermost shape of the developing unit 4 or the drum unit 5, which is to be inserted and removed, at each position, as shown in FIG. 8E. For this purpose, as shown in FIG. 8A, a curved portion 36*g* obtained by substantially offsetting the drum unit 5 is formed as a second guide portion, and a curved portion 36*f* corresponding to the developing unit 4 is likewise formed as a first guide portion in the left-right direction of the CRG lever 36. The curved portions 36*g* and 36*f* function as guide portions and also function as restricting portions for restricting the attachment and detachment of the unit when the position of the CRG lever 36 changes.

With such a configuration, either the developing unit 4 or the drum unit 5 is selectively determined according to the position of the CRG lever 36 as a unit that can be pulled out by the user from the apparatus main body. As a result, it is possible to prevent the occurrence of a situation in which two units are pulled out at the same time and the developing unit 4 or the drum unit 5 is dropped when the unit is replaced. Further, the possibility of rubbing or bumping the developing roller 24 and the photosensitive drum 1 which are in close proximity to each other, thereby causing image defects, when attempting to attach and detach two units at the same time is reduced. Furthermore, it is possible to prevent the occurrence of a situation in which each of two units can be simultaneously inserted with one hand. It is thus possible to prevent the developing roller 24 and the photosensitive drum 1 from coming into contact and damaging each other as a result of performing the mounting operation in an unstable state in which each of two units are held with one hand. Furthermore, the curved portions 36*g*, 36*f* provided on the CRG lever 36 function as guides when inserting and removing the developing unit 4 or the drum unit 5, thereby making it easier to insert the unit into the apparatus main body and contributing to improvement of usability.

2) FIGS. 9A to 9D

Figure 9B:
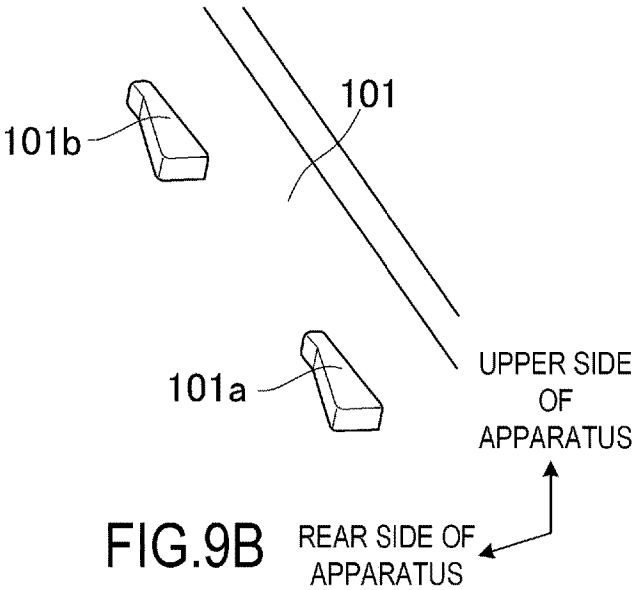
FIGS. 9A to 9D are schematic diagrams for explaining the movement of the switching member caused by the opening and closing of the access door.
Figure 9D:
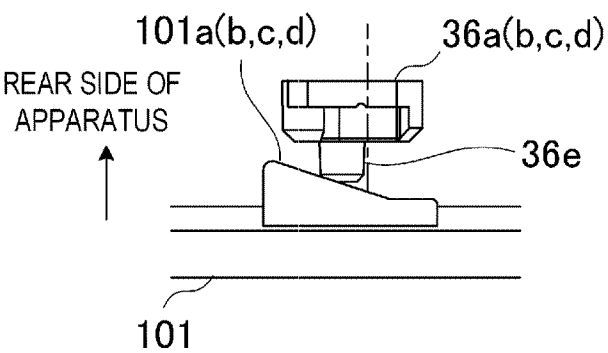
Figure 9A:
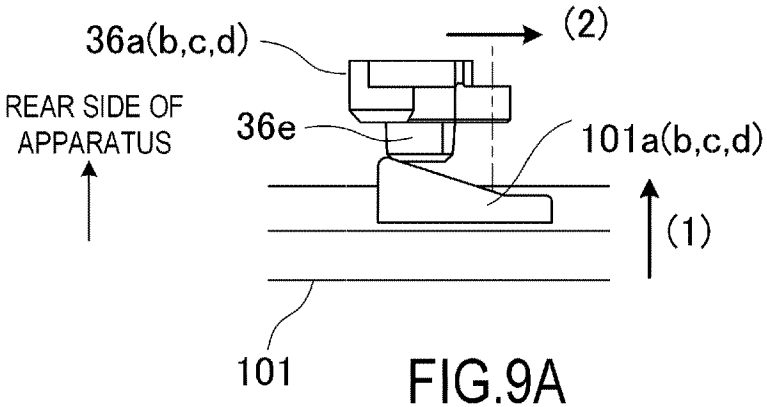
Figure 9C:
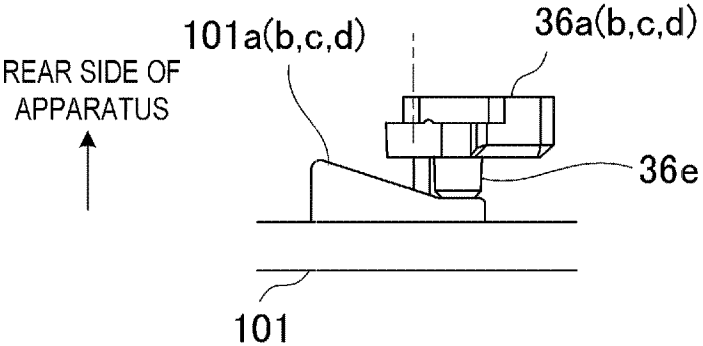

FIGS. 9A to 9D are schematic diagrams for explaining the function of moving the switching member 36 by the closing operation of the access door 101. Ribs 101*a*, 101*b*, 101*c*, 101*d* are provided inside the access door 101 as action portions for moving the switching member 36. FIG. 9A is a partial perspective view which is taken from the upper side on the front side of the apparatus when the rib 101*a* and the engaging portion 36*e* of the CRG lever 36 positioned at the restricting position of the developing unit 4 start coming into contact with each other shortly before the closing of the access door 101 is completed. FIG. 9B is a perspective view of the ribs 101*b*, 101*c*. FIG. 9C shows a state in which the access door 101 has been closed and the CRG lever 36 has moved to the restricting position of the drum unit 5. FIG. 9D shows a state between that in FIG. 9A and that in FIG. 9C.

As the user closes the access door 101 (the direction of an arrow (1) in FIG. 9A), the engaging portion 36*e* is rotated from the left to the right in the figure (direction of an arrow (2) in FIG. 9A) by the inclined portion of the rib 101*a* (the same for b, c, d). As a result, even if the CRG lever 36 is left at the first position or the second position after the user operates the process cartridge 7, the CRG lever 36 will automatically move to the first position when the access door 101 is closed.

In the present example, since the life of the drum unit 5 is longer than the life of the developing unit 4, the frequency of replacement of the developing unit 4 in the life of the apparatus main body is larger than that of the drum unit 5. Therefore, the configuration in which the CRG lever 36 is always at the first position when the access door 101 is closed, makes it unnecessary for the user to operate the CRG lever 36 when replacing at least the developing unit 4 having a high replacement frequency. This makes it possible to improve usability with respect to the operation of the CRG lever 36.

Variation Example

Specific configurations in which the present invention can be used are not limited to the above-described example, and various modifications are possible within the scope of the present invention.

In the above-described Example 1, the CRG lever 36 is moved to the first position by the closing operation of the access door 101, but this configuration is not limiting. Thus, the same usability as in the abovementioned example can be ensured also with the configuration in which the CRG lever 36 is moved to the first position by the opening operation of the access door 101.

Example 2

An image forming apparatus according to Example 2 of the present invention will be described hereinbelow. Since the overall configuration of the image forming apparatus and the selective replacement configuration of the process cartridge 7 using the CRG lever 36 as the switching member are the same as those in Example 1, the same reference numerals are assigned and the explanation thereof is herein omitted. Features not specifically described in Example 2 are the same as those in Example 1.

In the configuration of Example 1, the curved portions 36*g*, 36*f* of the CRG lever 36 serve as parts of the guide shape with respect to the process cartridge 7. Meanwhile, in Example 2, in addition to serving as parts of the guide shape with respect to the process cartridge 7, the curved portions 36*g* and 36*f* of the CRG lever 36 serve to retain the process cartridge 7 on the apparatus main body when the access door 101 is closed.

FIGS. 10A to 10D are schematic diagrams for explaining a configuration in the case where the CRG lever 36 itself is provided with a retainer for the process cartridge 7. FIG. 10A is a view taken when the access door 101 is in the open state and the CRG lever 36 is in the second position. FIG. 10B is a view taken when the access door 101 is in the open state and the CRG lever 36 is in the first position. FIG. 10C is a view taken when the access door 101 is in the closed state and the CRG lever 36 is in the third position. FIG. 10D is a partially enlarged view of FIG. 10C.

In the state shown in FIG. 10A, the drum unit 5 can be replaced from the apparatus main body in the same manner as in the state shown in FIG. 8E. Further, in the state shown in FIG. 10B, the developing unit 4 can be replaced in the same manner.

In the configuration of the present example, where the access door 101 is closed, the CRG lever 36 is brought into contact with the ribs 101*a*, 101*b*, 101*c*, 101*d* as the second action portions and moves to the third position different from the first position and the second position. Thus, the ribs of Example 2 are configured to move the CRG lever 36 to a position different from that attained with the ribs of Example 1. As shown in FIGS. 10C and 10D, the third position is a position in which the outermost shape of the CRG lever 36 not only overlaps the outer shape of the drum unit 5, but also covers a part of the outermost shape of the developing unit 4 (locations X and Y in FIG. 10D). Thus, the third position is a position where the movement of the drum unit 5 and the developing unit 4 in the insertion and removal direction with respect to the apparatus main body is restricted by the CRG lever 36 and also a position where the drum unit 5 and the developing unit 4 are aligned with respect to the apparatus main body. Accordingly, in this example, the process cartridge 7 can be prevented from coming off the apparatus main body (displacement of the process cartridge can be prevented) by setting the access door 101 to a closed state. More specifically, it is possible to stabilize the position of the process cartridge 7 in the front-rear direction of the product during image formation. Further, when transporting the process cartridge 7 in a state of being housed in the apparatus main body, it is possible to press the process cartridge 7 not only with the access door 101, but also to press the process cartridge 7 with the CRG lever 36.

A configuration may be also used in which the CRG lever 36 is moved from the third position to the first position by the opening operation of the access door 101.

Example 3

An image forming apparatus according to Example 3 of the present invention will be described hereinbelow. Since the overall configuration of the image forming apparatus and the selective replacement configuration of the process cartridge 7 using the CRG lever 36 as the switching member are the same as those in Example 1, the same reference numerals are assigned and the explanation thereof is herein omitted. Features not specifically described in Example 3 are the same as those in Example 1.

In the configuration of Example 1, the curved portions 36*g*, 36*f* of the CRG lever 36 serve as parts of the guide shape with respect to the process cartridge 7. By contrast, in Example 3, an indication portion 36*k* is provided at the rotation center of the CRG lever 36.

Figure 11:
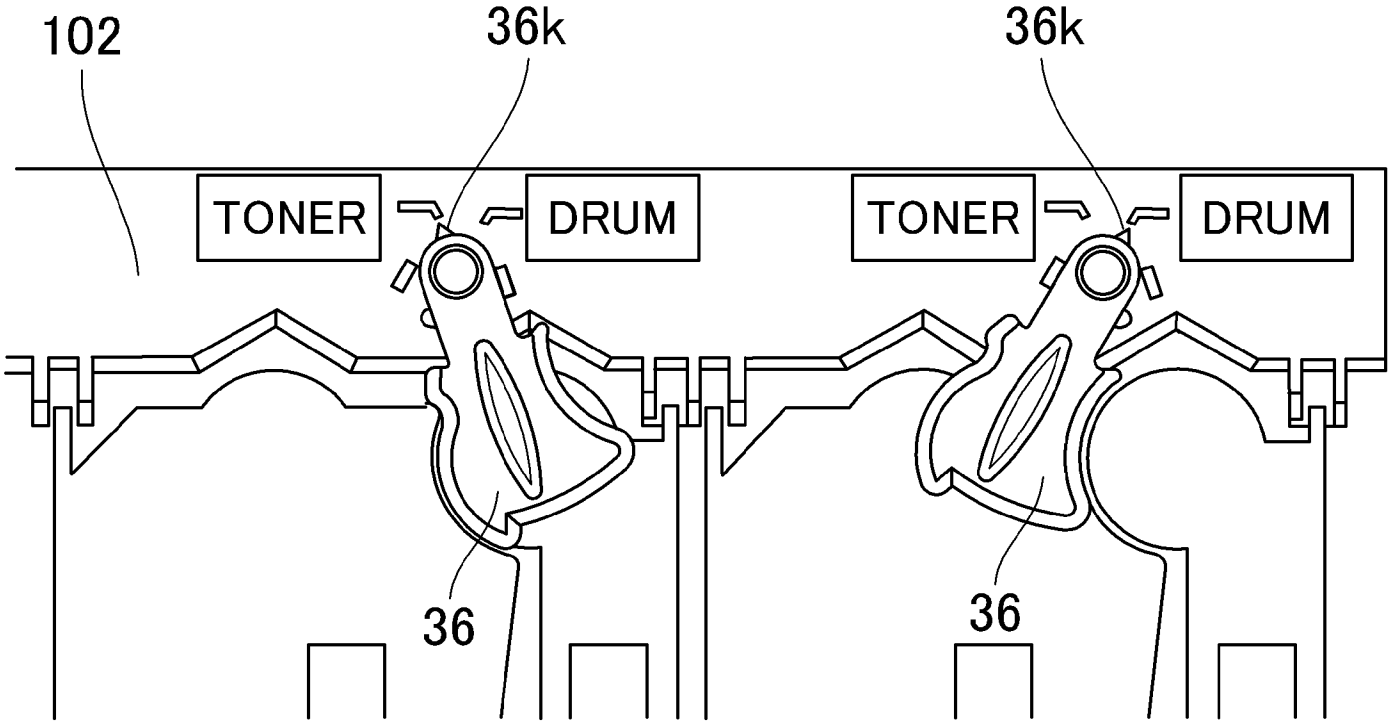
FIG. 11 is a schematic diagram for explaining the configuration of the switching member and the frame in Example 3 of the present invention.

FIG. 11 is a schematic diagram showing the state of the apparatus main body frame 102 in the vicinity of the CRG lever 36 in this example. In this configuration, when the CRG lever 36 assumes the first position or the second position, "DRUM" and "TONER" are clearly indicated on the frame 102 opposed to the indication portion 36*h*, and the unit which can be replaced is indicated to the user. That is, in this configuration, which unit is allowed to be attached to and detached from the apparatus main body is indicated by the orientation of the CRG lever 36 in the first position or the second position with respect to the frame 102. In this way, by using the CRG lever 36 as a part of position display means, it is possible to notify the user of the meaning of the position of the CRG lever 36 and to improve the usability.

Example 4

An image forming apparatus according to Example 4 of the present invention will be described hereinbelow. Since the overall configuration of the image forming apparatus and the selective replacement configuration of the process cartridge 7 using the CRG lever 36 as the switching member are the same as those in Example 1, the same reference numerals are assigned and the explanation thereof is herein omitted. Features not specifically described in Example 4 are the same as those in Example 1.

In the configuration of Example 1, the switching member 36 is a lever swinging with respect to the process cartridge 7. Meanwhile, in Example 4, a CRG slider 37 (37*a*, 37*b*, 37*c*, 37*d*) which linearly moves in the left-right direction of the apparatus with respect to the frame 102 is provided.

Figure 12A:
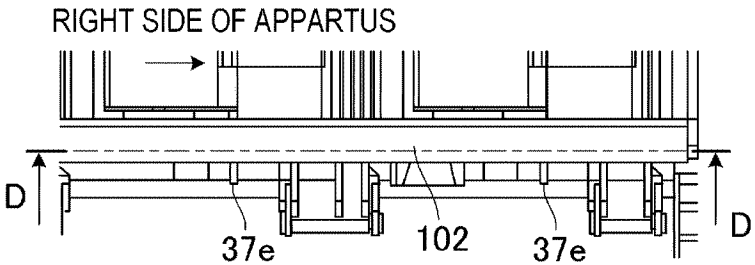
FIGS. 12A to 12E are schematic diagrams for explaining the configuration of the switching member in Example 4.
Figure 12B:
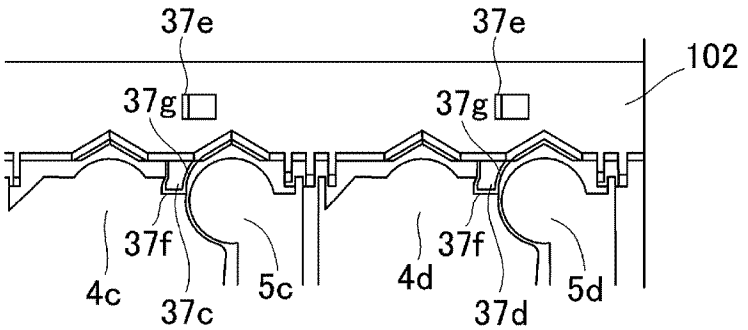
Figure 12C:
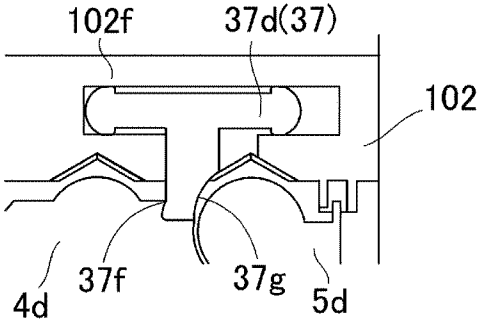
Figure 12D:
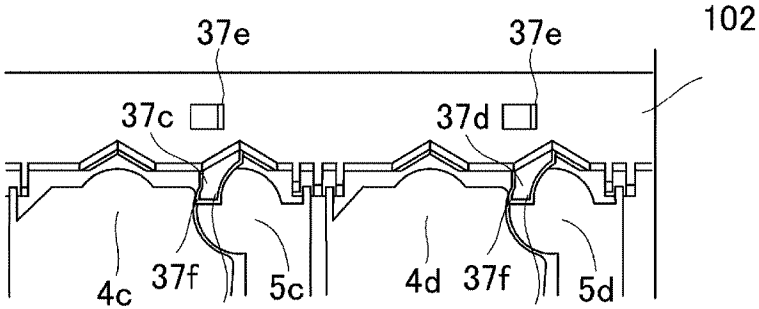
Figure 12E:
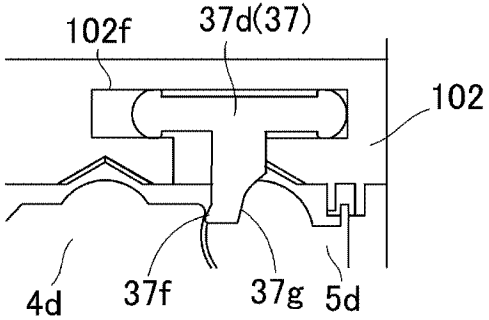

FIGS. 12A to 12E are views showing a configuration in which a CRG slider 37 is provided as a switching member at the frame 102. FIG. 12A is a top view of the vicinity of the cyan (C) and black (K) stations. FIG. 12B shows a state in which the CRG sliders 37*c* and 37*d* are positioned on the left side of the apparatus and the drum unit 5 can be replaced (a state in which the restricting portion 37*f* restricts the attachment and detachment of the developing unit 4). Meanwhile, FIG. 12D shows a state in which the developing unit 4 can be replaced (a state in which the restricting portion (curved portion) 37*g* restricts the attachment and detachment of the drum unit 5). FIGS. 12C and 12E are cross-sectional views taken along a line D-D in FIG. 12A and corresponding to FIGS. 12B and 12D.

The CRG slider 37 as the switching member is guided so as to be linearly movable in the left-right direction of the product by the guide portion 102*f* of the frame 102. With such a slide configuration, the process cartridge 7 may be configured to be selectively insertable and removable.

Figure 13B:
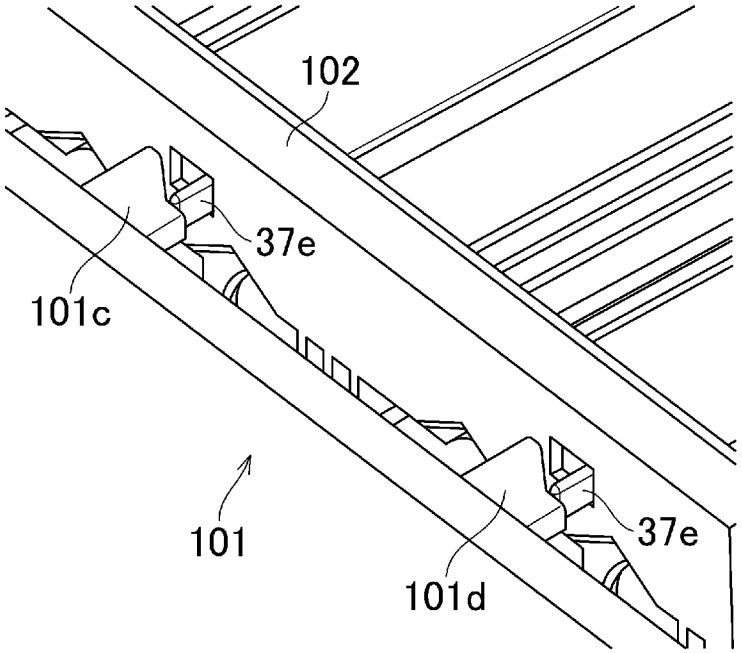
FIGS. 13A and 13B are views for explaining the relationship between the switching member and the access door in Example 4.
Figure 13A:
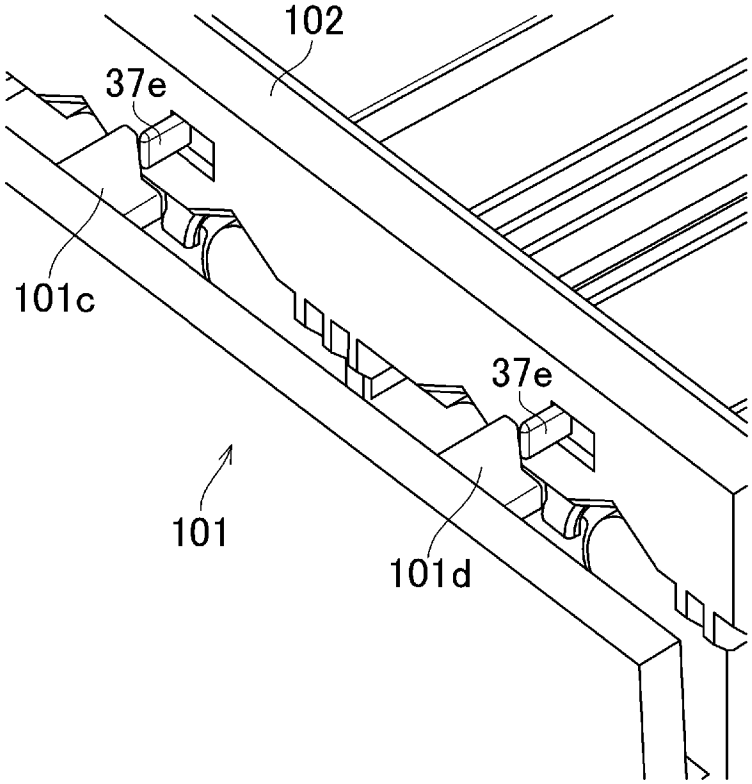

In this case, as the access door 101 is closed, the ribs 101*a*, 101*b*, 101*c*, 101*d* provided on the inner wall surface of the access door 101 come into contact with engaging portions 37*e* of the CRG sliders 37*a*, 37*b*, 37*c*, 37*d* (FIGS. 13A and 13B). As a result, along with the movement of the access door 101 in the closing direction, the engaging portions 37*e* are caused to slide along the inclined surfaces provided on the ribs 101*a* to 101*d*. As a consequence, it is possible to obtain the configuration in which the CRG sliders 37*a*, 37*b*, 37*c*, 37*d* are set to the predetermined positions by closing the access door 101, and the attachment and detachment of the drum unit 5 is restricted when the access door 101 is opened.

Variation Example

Specific configurations in which the present invention can be used are not limited to the above-described example, and various modifications are possible within the scope of the present invention.

In the above-described Example 4, the switching member 37 is provided for each of the colors of yellow (Y), magenta (M), cyan (C), and black (K), and the developing unit 4 and the drum unit 5 that are adjacent to each other can be selectively inserted and removed for each color, but such a configuration is not limiting. For example, the switching members 37 may be integrated for a plurality of colors so as to restrict the insertion and removal of the plurality of developing units 4 or the plurality of drum units 5.

Figures 14A, 14B, 14C:
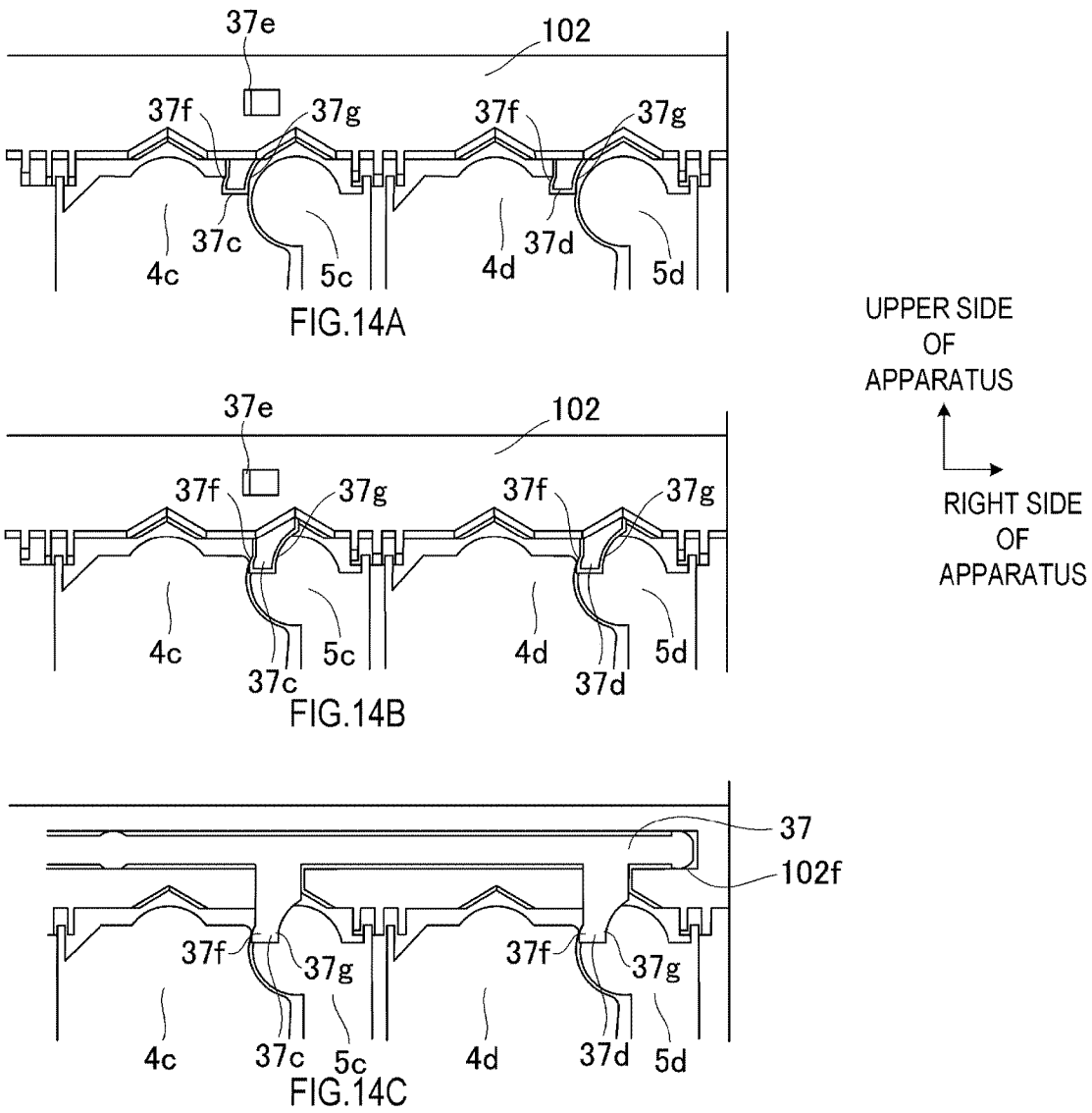
FIGS. 14A to 14C are schematic diagrams for explaining the configuration of the switching member in a variation example of Example 4.

FIGS. 14A to 14C are schematic diagrams showing a configuration in the case where the switching members of all the colors are integrated. FIG. 14A shows a state in which the switching member 37 enables the insertion and removal of the drum unit 5 to and from the frame 102. FIG. 14B shows a state in which the switching member 37 enables the insertion and removal of the developing unit 4 to and from the frame 102. FIG. 14C is a partial sectional view similar to FIGS. 12C and 12E.

By using such a configuration, the user can selectively perform the operation of inserting and removing the developing unit 4 and the drum unit 5 with the switching member 37 with respect not only to the adjacent units but also to units at a certain distance from each other. As a result, it is possible to prevent, for example, the rollers of the units from hitting each other during insertion and removal.

Example 5

An image forming apparatus according to Example 5 of the present invention will be described hereinbelow. Since the overall configuration of the image forming apparatus and the selective replacement configuration of the process cartridge 7 using the CRG lever 36 as the switching member are the same as those in Example 1, the same reference numerals are assigned and the explanation thereof is herein omitted. Features not specifically described in Example 5 are the same as those in Example 1.

In the configuration of Example 1, the switching member 36 is a lever swinging with respect to the process cartridge 7. In addition to this, in Example 5, the restricting member 38 (38*a*, 38*b*, 38*c*, 38*d*) is provided on the frame 102 to restrict the rotation of the switching member 36.

Figure 15:
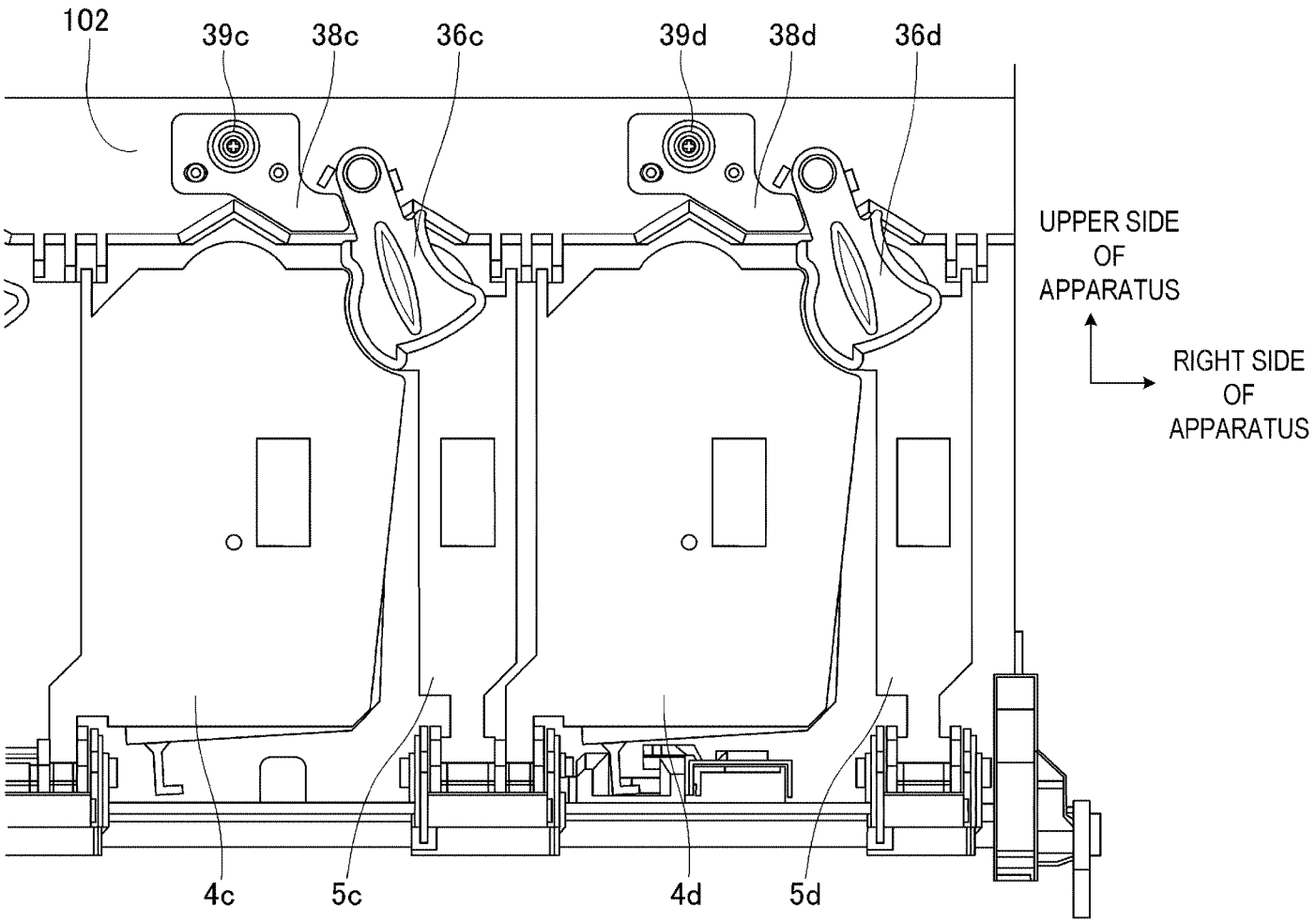
FIG. 15 is a schematic diagram for explaining the configuration of the switching member and the frame in Example 5.

FIG. 15 shows a configuration in which the restricting member 38 is provided on the frame 102. FIG. 15 is a front view of the vicinity of the cyan (C) and black (K) stations. FIG. 15 is a view taken when the access door 101 is in the open state and the CRG lever 36 is in the first position. The view shows the state in which the CRG levers 36*c*, 36*d* are positioned on the right side of the apparatus and the developing unit 4 can be replaced (the state in which the CRG lever 36 restricts the attachment and detachment of the drum unit 5). In this state, the restricting member 38 restricts the movement of the CRG lever 36 from the first position to the second position and also restricts the attachment and detachment of the drum unit 5.

Figure 16B:
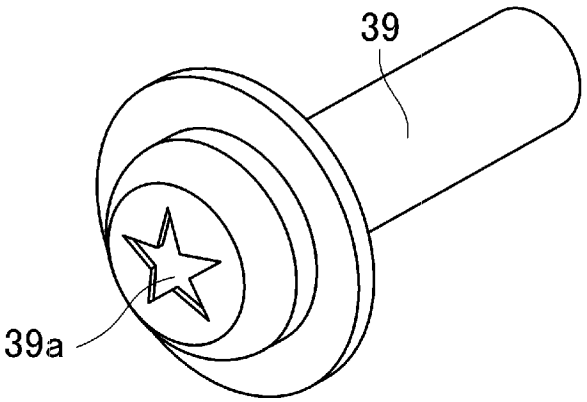
FIGS. 16A and 16B are schematic diagrams for explaining the configuration of a fixing member in Example 5.
Figure 16A:
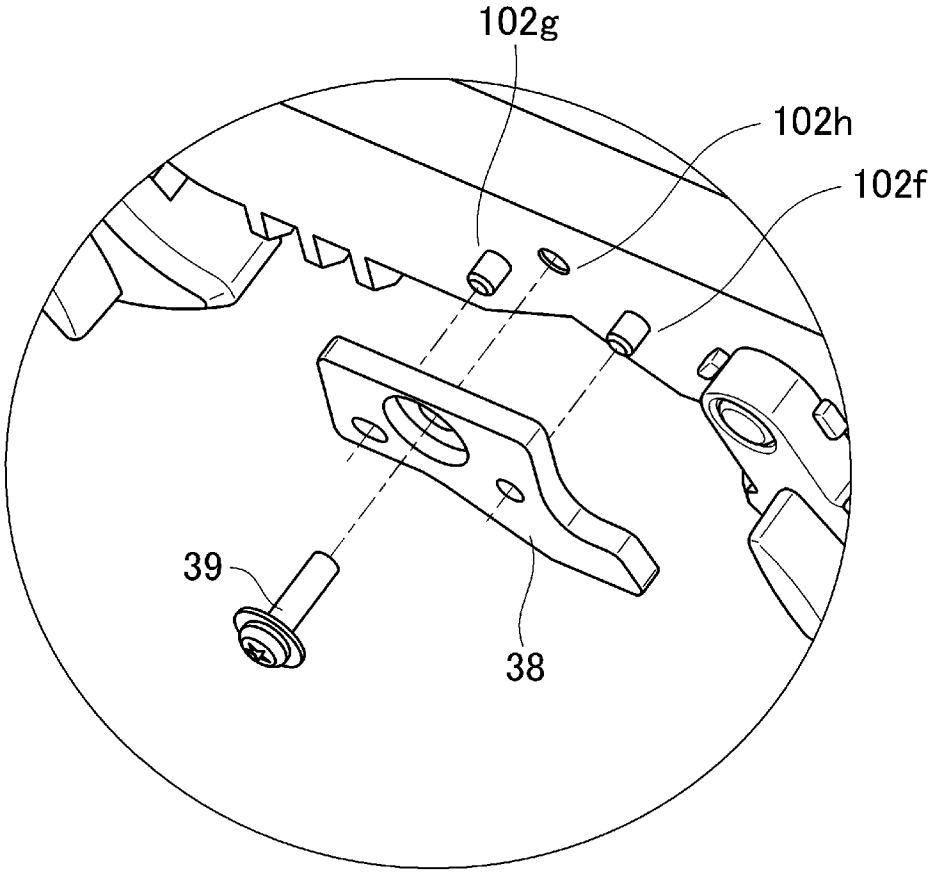

FIGS. 16A and 16B show the attachment structure of the restricting member 38 to the frame 102. FIG. 16A is a perspective view showing how the restricting member 38 is fixed to the frame 102 with a screw 39. FIG. 16B shows an example of the screw 39. The restricting member 38 is positioned correspondingly to positioning bosses 102*g*, 102*f* and a female screw hole 102*h* provided in each station, and the restricting member 38 is fastened to the frame 102 by the screw 39. In FIG. 16B, the screw head is exemplified by a star head. Security can be set for replacement of the process cartridge 7 by using a screw with an irregularly shaped head such as TORX (registered trademark) instead of typical plus or minus screw heads. Further, it is also possible to set the level of restriction for each color of yellow (Y), magenta (M), cyan (C), and black (K). Depending on the purpose of the user and the operating environment of the apparatus, by adding such a restricting member 38, it is also possible to restrict the replacement of the process cartridge 7 in a small space and at a low cost.

Variation Example

Specific configurations in which the present invention can be used are not limited to the above-described example, and various modifications are possible within the scope of the present invention.

In the above-described Example 5, the restricting member 38 is provided on the frame 102 so that only the developing unit 4 of the adjacent units can be selectively inserted and removed for one color, but such a configuration is not limiting. For example, as a result of changing the inclined surface portions (cam portions) of the ribs 101*a*, 101*b*, 101*c*, 101*d* to the opposite direction as the second action portions on the access door 101 shown in FIGS. 9A to 9D, the CRG lever 36 also can move to the position restricting the developing unit 4 when the access door 101 is closed. In addition, similarly to Example 5, a configuration can be used in which the restricting member 38 is fixed so as to restrict the rotation of the CRG lever 36, and only the drum unit 5 of the adjacent units can be selectively inserted and removed.

Apart from this, the attachment and detachment of both the developing unit 4 and the drum unit 5 can be also simultaneously restricted by the shape of the restricting member 38.

Figure 17:
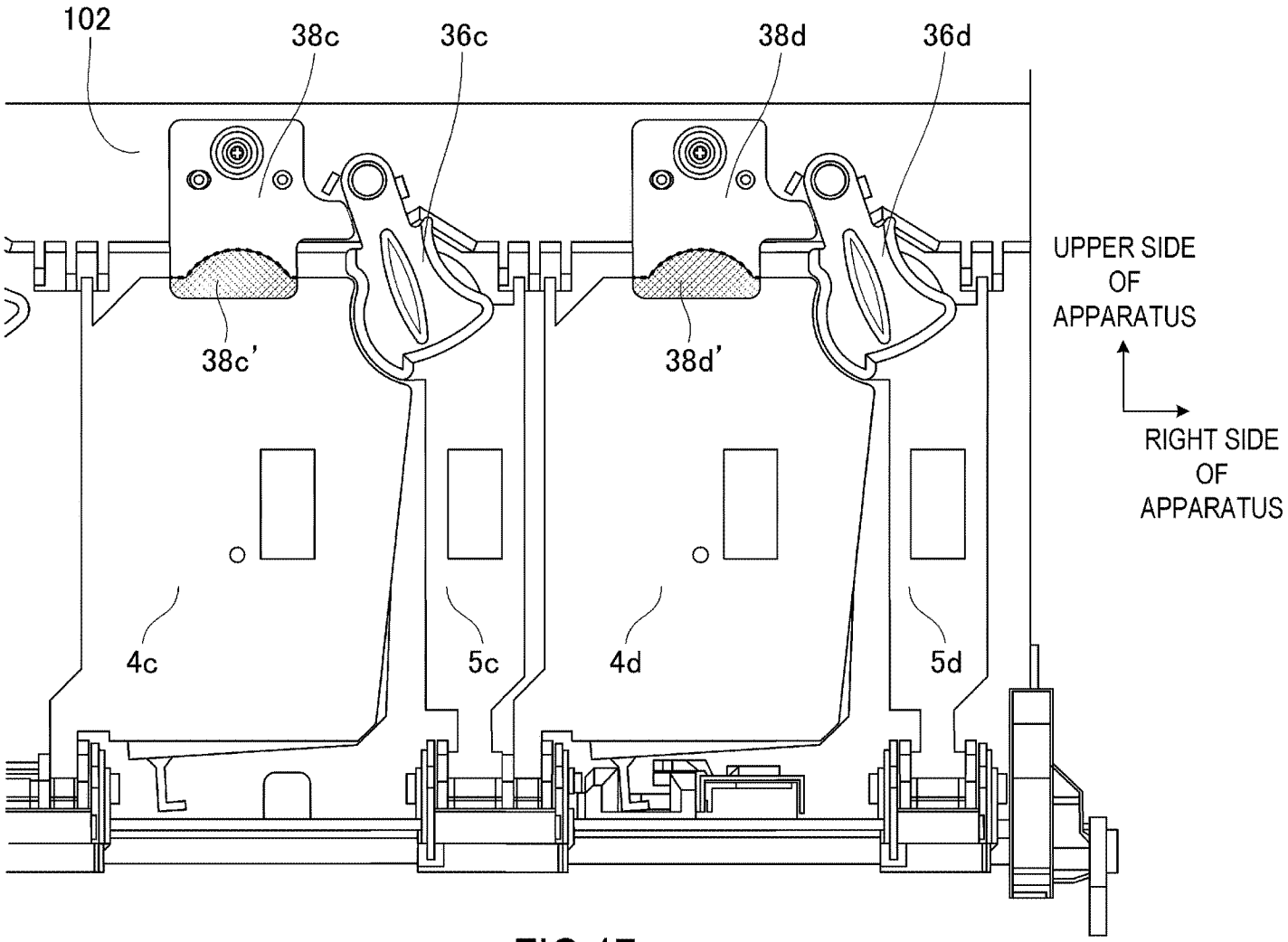
FIG. 17 is a schematic diagram for explaining the configuration of the switching member and the frame in a variation example of Example 5.

FIG. 17 is a schematic diagram showing a configuration in which the attachment and detachment of the developing unit 4 and the drum unit 5 are restricted at the same time. This is the front view of the vicinity of the cyan (C) and black (K) stations in which, similarly to the view shown in FIG. 15, the restricting member 38 is provided on the frame 102. The restricting members 38*c*, 38*d* are engaged with respective parts of the developing units 4*c*, 4*d*, while facing in the insertion and removal direction, in regions 38*c*', 38*d*' (shaded portions in the figure) in the projection direction from the front of the apparatus. Thus, the attachment and detachment not only of the drum unit 5 but also of the developing unit 4 can be restricted. That is, the configuration is obtained in which the restricting member 38 has not only a switching member restricting portion for restricting the movement of the CRG lever 36 from the first position to the second position, but also a unit restricting portion for restricting the attachment and detachment of the developing unit 4. By contrast with the configuration shown in FIG. 17, the restricting member 38 may be configured to restrict the movement of the CRG lever 36 from the second position to the first position and also to restrict the attachment and detachment of the drum unit 5.

Further, in the configuration of the CRG slider 37 shown in Example 4, the CRG slider 37 can be also restricted by adding the restricting member 38.

Example 6

An image forming apparatus according to Example 6 of the present invention will be described hereinbelow. Since the overall configuration of the image forming apparatus and the selective replacement configuration of the process cartridge 7 using the CRG lever 36 as the switching member are the same as those in Example 5, the same reference numerals are assigned and the explanation thereof is herein omitted. Features not specifically described in Example 6 are the same as those in Example 5.

In the configuration of Example 5, the swinging lever is restricted by the restricting member 38 with respect to the switching member 36 (CRG lever). Meanwhile, in Example 6, the restricting member 38 is added in the configuration in which a display member 104 (104*a*, 104*b*, 104*c*, 104*d*) is provided to the frame 102.

Figure 18B:
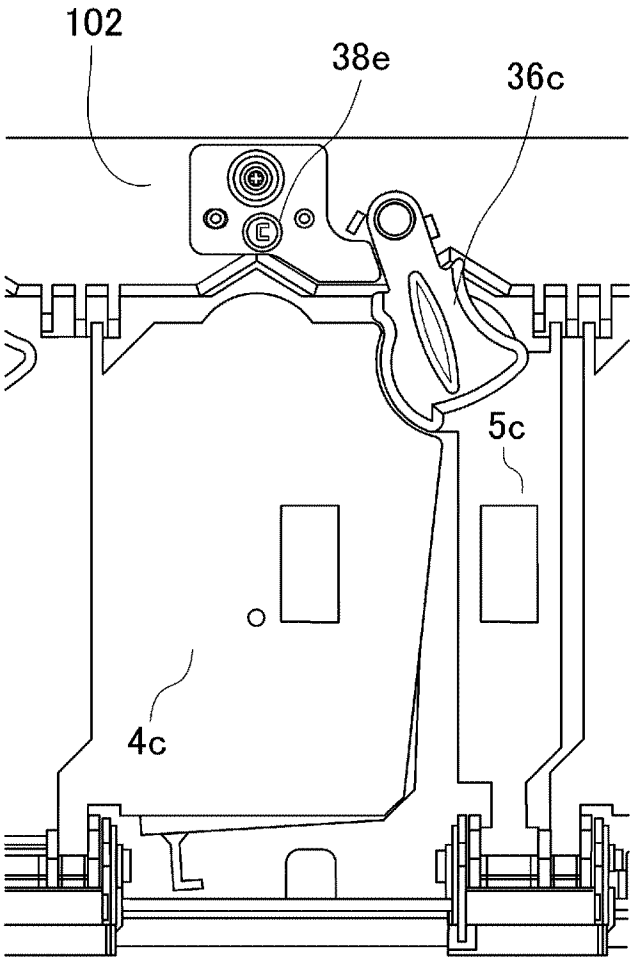
FIGS. 18A and 18B are schematic diagrams for explaining the configuration of the switching member and the frame in Example 6.
Figure 18A:
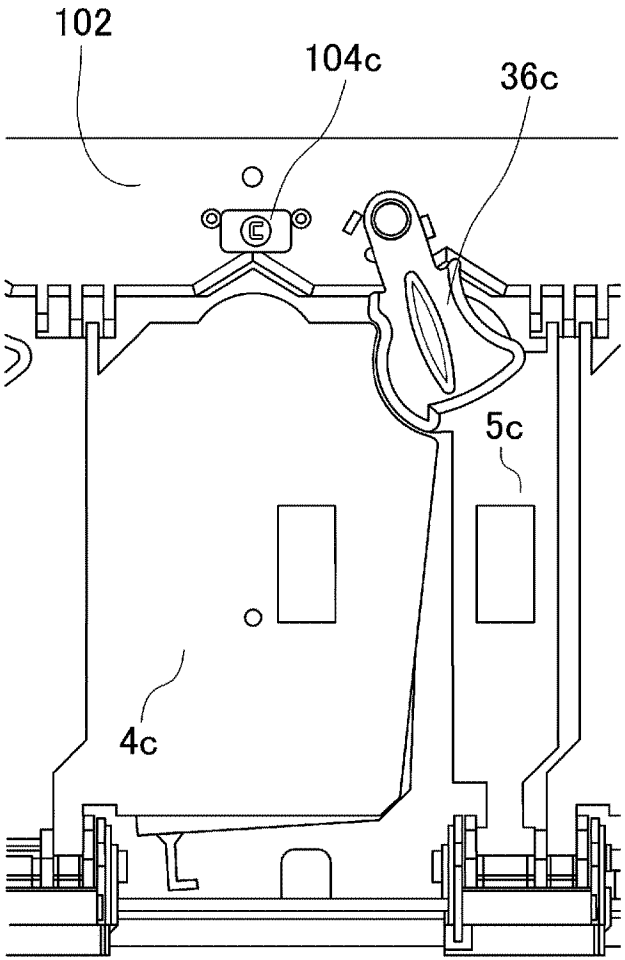

FIGS. 18A and 18B show a configuration in which the display member 104 is provided on the frame 102. FIGS. 18A and 18B are front views of the vicinity of the cyan (C) station. FIGS. 18A and 18B are views taken when the access door 101 is in the open state and the CRG lever 36 is in the first position. The state in which the CRG lever 36*c* is positioned on the right side of the apparatus and the developing unit 4 can be replaced (the state in which the CRG lever 36 restricts the attachment and detachment of the drum unit 5) is shown. FIG. 18A shows the case without the restricting member 38, and FIG. 18B shows the case with the restricting member 38. The display member 104 indicates the color of the station to the user (a display portion displaying information on the color of the developer corresponding to the unit) and helps to place the process cartridge 7 to a proper position. Because of its role, the display member 104 is often installed near the approximate center of the developing cartridge 4*c* in the lateral direction of the product as shown in FIG. 18A. Accordingly, in FIG. 18B, a hole-like relief shape 38*e* is formed in the restricting member 38. As a result, even when the restricting member 38 is added and the CRG lever 36 is fixed at the first position, when the developing cartridge 4*c* is attached or detached, it is possible to notify the user that the station is a cyan (C) station. In this way, when the restricting member 38 is added, the restricting member 38 is disposed at a position where the display member 104 is not shielded. That is, the restricting member 38 is configured to have a shape that does not hinder the visibility of the display content of the display member 104, or to be arranged at such a position. As a result, even in a state in which the CRG lever 38 is fixed, the display member 104 can notify the user of the developing unit 4 to be replaced and can guide the user to the correct station.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-214550, filed on Nov. 1, 2016 which is hereby incorporated by reference herein in its entirety.

What is claimed is:

1. An image forming apparatus comprising:

an apparatus main body having a mounting portion; and first and second units individually mountable to and detachable from the mounting portion, wherein the apparatus main body includes:

a switching member movable between a first position and a second position, the first position being a position in which attachment and detachment of the first unit with respect to the apparatus main body is allowed and attachment and detachment of the second unit with respect to the apparatus main body is restricted, and the second position being a position in which the attachment and detachment of the first unit is restricted and the attachment and detachment of the second unit is allowed;

an opening through which the first and second units are detachably attachable to the mounting portion; and an opening and closing member movable between an open position where the opening is not covered by the opening and closing member and a closed position where the opening is covered by the opening and the closing member, wherein the switching member is configured to move from the second position to the first position in conjunction with movement of the opening and closing member from the open position to the closed position.

2. The image forming apparatus according to claim 1, wherein the opening and closing member has an action portion that moves the switching member from the second position to the first position when the opening and closing member moves from the open position to the closed position, and the switching member is configured not to be moved from the first position to the second position by movement of the opening and closing member from the closed position to the open position.

3. The image forming apparatus according to claim 1, wherein the switching member is covered by the opening and closing member when the opening and closing member is in the closed position, and the switching member is not covered by the opening and closing member so as to be exposed to the outside of the apparatus main body when the opening and closing member is in the open position.

4. The image forming apparatus according to claim 1, wherein the switching member includes:

a first guide portion that guides the first one unit when the first unit is moved toward the mounting portion when the switching member is at the first position; and a second guide portion that guides the second unit when the second unit is moved toward the mounting portion when the switching member is at the second position.

5. The image forming apparatus according to claim 1, wherein the switching member is configured to be rotated between the first position and the second position about an axis parallel to a direction in which the first and second units are attached to the mounting portion.

6. The image forming apparatus according to claim 1, wherein the switching member is moved between the first position and the second position in a direction orthogonal to a direction in which the first and second units are attached to the mounting portion.

7. The image forming apparatus according to claim 1, wherein the second unit includes a photosensitive drum, and the first unit includes a developing roller configured to bear developer and supply the developer to the photosensitive drum.

8. The image forming apparatus according to claim 1, further comprising a restricting member for restricting the movement of the switching member between the first position and second position.

9. The image forming apparatus according to claim 8, wherein the restricting member prevents simultaneous attachment and detachment of both the first unit and the second unit.

10. The image forming apparatus according to claim 1, wherein the first and second units are configured to be mounted to and dismounted from the mounting portion in a mounting and dismounting direction.

11. The image forming apparatus according to claim 10, wherein the first and second units, when mounted at the mounting portion, are arranged adjacent to each other in a direction orthogonal to the mounting and dismounting direction.

12. The image forming apparatus according to claim 11, wherein the switching member at the first position is arranged downstream of a downstream end of the second unit in a dismounting direction of the mounting and dismounting direction and is arranged so as to overlap with the second unit and so as not to overlap with the first unit when viewed in the mounting and dismounting direction, and wherein the switching member at the second position is arranged downstream of a downstream end of the first unit in the dismounting direction and is arranged so as to overlap with the first unit and so as not to overlap with the second unit when viewed in the predetermined direction.

13. An image forming apparatus comprising:

an apparatus main body having a mounting portion;

a drum unit having a photosensitive drum mountable to and detachable from the mounting portion; and a developer unit mountable to and detachable from the mounting portion, the developer unit having a developing roller configured to bear developer and supply the developer to the photosensitive drum;

wherein the apparatus main body includes:

a switching member movable between a first position and a second position, the first position being a position in which attachment and detachment of the developer unit with respect to the apparatus main body is allowed and attachment and detachment of the drum unit with respect to the apparatus main body is restricted, and the second position being a position in which the attachment and detachment of the developer unit is restricted and the attachment and detachment of the drum unit is allowed.

14. The image forming apparatus according to claim 13, wherein the drum unit and the developer unit are configured to be mounted to and dismounted from the mounting portion in a mounting and dismounting direction.

15. The image forming apparatus according to claim 14, wherein the drum unit and the developer unit, when mounted at the mounting portion, are arranged adjacent to each other in a direction orthogonal to the mounting and dismounting direction.

16. The image forming apparatus according to claim 15, wherein the switching member at the first position is arranged downstream of a downstream end of the drum unit in a dismounting direction of the mounting and dismounting direction and is arranged so as to overlap with the drum unit and so as not to overlap with the developer unit when viewed in the mounting and dismounting direction, and wherein the switching member at the second position is arranged downstream of a downstream end of the developer unit in the dismounting direction and is arranged so as to overlap with the developer unit and so as not to overlap with the drum unit when viewed in the mounting and dismounting direction.

17. An image forming apparatus comprising:

an apparatus main body having a mounting portion; and first and second units individually mountable to and detachable from the mounting portion in a mounting and dismounting direction, wherein the apparatus main body includes:

a switching member movable between a first position and a second position, the first position being a position in which the switching member is arranged downstream of a downstream end of the second unit in a dismounting direction of the mounting and dismounting direction and is arranged so as to overlap with the second unit and so as not to overlap with the first unit when viewed in the mounting and dismounting direction, the second position being a position in which the switching member is arranged downstream of a downstream end of the first unit in the dismounting direction and is arranged so as to overlap with the first unit and so as not to overlap with the second unit when viewed in the mounting and dismounting direction.

* * * * *